US007843290B2

(12) United States Patent
Song et al.

(10) Patent No.: US 7,843,290 B2
(45) Date of Patent: Nov. 30, 2010

(54) MOLDED CASE CIRCUIT BREAKER WITH CONTACT ON MECHANISM

(75) Inventors: Jung-Chun Song, Chungcheongbuk-Do (KR); Sang-Hwan Lim, Chungcheongbuk-Do (KR); Sung-Woo Kang, Seoul (KR)

(73) Assignee: LS Industrial Systems Co., Ltd., Gyeonggi-do (KR)

( * ) Notice: Subject to any disclaimer, the term of this patent is extended or adjusted under 35 U.S.C. 154(b) by 304 days.

(21) Appl. No.: 12/179,831

(22) Filed: Jul. 25, 2008

(65) Prior Publication Data

US 2009/0039988 A1 Feb. 12, 2009

(30) Foreign Application Priority Data

Aug. 10, 2007 (KR) ..... 10-2007-0080900
Aug. 10, 2007 (KR) ..... 10-2007-0080902
Aug. 10, 2007 (KR) ..... 10-2007-0080903

(51) Int. Cl.
*H01H 71/12* (2006.01)
*H01H 73/02* (2006.01)

(52) U.S. Cl. ..... 335/6; 335/21; 335/172; 200/401

(58) Field of Classification Search ..... 335/6, 335/21, 172; 200/401
See application file for complete search history.

(56) References Cited

U.S. PATENT DOCUMENTS 4,401,872 A * 8/1983 Boichot-Castagne et al. ..... 200/401
4,528,531 A * 7/1985 Flick et al. ..... 335/23
4,679,016 A * 7/1987 Ciarcia et al. ..... 335/132
4,731,921 A * 3/1988 Ciarcia et al. ..... 29/622
4,978,816 A * 12/1990 Castonguay et al. ..... 200/43.14
5,142,112 A * 8/1992 Parks et al. ..... 200/401
5,165,532 A * 11/1992 Pipich et al. ..... 200/401
5,184,717 A * 2/1993 Chou et al. ..... 200/401
5,200,724 A * 4/1993 Gula et al. ..... 335/166
5,213,206 A * 5/1993 Beck et al. ..... 200/401

(Continued)

FOREIGN PATENT DOCUMENTS

JP 10-275553 10/1998

OTHER PUBLICATIONS

English language Abstract and translation of JP 10-275553, Oct. 13, 1998.

*Primary Examiner*—Ramon M Barrera
(74) *Attorney, Agent, or Firm*—Greenblum & Bernstein P.L.C.

(57) ABSTRACT

A molded case circuit breaker having a contact on mechanism which can perform a trip operation and automatically rotates the handle to the on position or a position toward the on position if the handle is manipulated to move to the off (or reset) position in a state that the contacts are melt-adhered to each other, the contact on mechanism, including: a contact on plate which is vertically movable by being guided according to the operation of the switching mechanism, a trip bar that drives the restricting unit to a releasing position, a lever connected to the handle and that provides a pivot point of the handle, a lever pin fixed to the lever, for driving the restricting unit to the releasing position by pressing the trip bar, and thereby operating the switching mechanism to the trip position, and a trip spring providing an elastic driving force for enabling the switching mechanism to operate to the trip position when the restricting unit is moved to the releasing position.

16 Claims, 17 Drawing Sheets

U.S. PATENT DOCUMENTS 5,361,052 A * 11/1994 Ferullo et al. ..... 335/172
5,430,422 A * 7/1995 Gibson ..... 335/172
5,543,595 A * 8/1996 Mader et al. ..... 200/401
6,031,438 A * 2/2000 Runyan ..... 335/172
6,084,191 A * 7/2000 Kataya et al. ..... 200/401
6,166,344 A * 12/2000 Castonguay et al. ..... 200/401
6,222,143 B1 * 4/2001 Lawson et al. ..... 200/401
6,985,059 B2 * 1/2006 Subramanian et al. ..... 335/172
7,045,733 B2 * 5/2006 Bresciani et al. ..... 200/400
2005/0051414 A1 * 3/2005 Subramanian et al. ..... 200/401
2008/0122563 A1 5/2008 Song

* cited by examiner

MOLDED CASE CIRCUIT BREAKER WITH CONTACT ON MECHANISM

RELATED APPLICATION

The present disclosure relates to subject matter contained in priority Korean Applications No. 10-2007-0080900, 10-2007-0080902 and 10-2007-0080903, filed on Aug. 10, 2007, which are herein expressly incorporated by reference in its entirety.

BACKGROUND OF THE INVENTION

1. Field of the Invention

The present invention relates to a molded case circuit breaker, and more particularly, to a molded case circuit breaker having a contact on mechanism.

2. Description of the Background Art

In general, a molded case circuit breaker is a protective electrical device to protect an electrical load equipment and an electrical line from an overload or overcurrent which may occur in an electrical circuit, by automatically breaking the electrical circuit. In such molded case circuit breaker, a position of a handle, which is manually manipulated by a user, may be divided into a mechanism release position by a switching mechanism (i.e., a TRIP position), a circuit opening position (i.e., an OFF position, in other words RESET position), and a circuit closing position (i.e., an ON position). When a fault current (or an abnormal current, etc.) occurs, the molded case circuit breaker performs a trip operation, and the handle indicates another position, except the on position. Meanwhile, due to a contact melt-adhered state of a movable contactor and a fixed contactor or any other reasons, when the contacts of the movable contactor and the fixed contactor are not separated from each other, a user manipulates the handle to move its position to the reset position, i.e., off position, such that the handle is moved to the on position or a position towards the on position indicating and warning to a user that the molded case circuit breaker is conducted. Here, the handle would automatically indicate the on position or a position near the on position, without indicating the off position (without being in the off position), thereby notifying the user of a conducted state in which the contacts of the movable contactor and the fixed contactor are currently contacted to each other. Such operation (function) is referred to as a "contact on operation (function)." The present invention is to provide a molded case circuit breaker having a mechanism performing the "contact on operation."

In order to implement the contact on operation in which the handle automatically indicates the on position when the contacts are contacted and thusly in the conducted state, a position of a toggle pin serving as a connection means between an upper link and a lower link should not go beyond a position of a hinge point (i.e., a pivot) of a lever for rotatably supporting the handle. Here, the upper and lower links serve as a drive unit connected between a shaft for supporting and driving the movable contactor and the handle. That is, when viewed at the front, the toggle pin should be positioned at a left side of the hinge point (pivot). Meanwhile, in the tripped state, the position of the toggle pin should go beyond the position of the lever hinge point, i.e., at a right side of the hinge point. Accordingly, such respective positions during the contact on operation and in the tripped state are opposite.

In order to implement both the contact on operation and the trip operation, there is a need to adjust the position of the bending point between the upper link and the lower link as well as length ratio between the upper link and the lower link.

Accordingly, there may be a structural problem of causing unstableness of the switching mechanism so as to satisfy the condition of the opposite positions.

In addition, a method for preventing the handle from going towards the off position by installing a stopper so as to restrict the lever may be proposed. Here, the handle would be stopped near the off position, not exactly at the off position. This may cause a problem of not performing the contact on operation when the contacts are contacted and thusly in the conducted state.

SUMMARY OF THE INVENTION

Therefore, it is an object of the present invention to provide a molded case circuit breaker having a contact on mechanism, which is stable without causing unstableness of a switching mechanism and enables a handle to accurately indicate an on position or a position towards the on position without installing a stopper.

To achieve this and other advantages and in accordance with the purpose of the present invention, as embodied and broadly described herein, in a molded case circuit breaker, which includes fixed contactors, a movable contactor which is movable to a position for contacting the fixed contactors or to a position for being separated from the fixed contactors, a switching mechanism for driving the movable contactor to contact to or be separated from the fixed contactors so as to open/close a circuit, a restricting unit for restricting the switching mechanism, and a handle for manually opening/closing the switching mechanism, the molded case circuit breaker, comprising: a contact on mechanism which trips the switching mechanism by releasing the restricting unit and automatically rotates the handle towards an on position even without manual power so as to indicate a conducted state when the handle is manipulated to move its position to an off position (or reset position) in a state that contacts of the movable contactor and the fixed contactors are melt-adhered to each other.

To achieve this and other advantages and in accordance with the purpose of the present invention, as embodied and broadly described herein, in a molded case circuit breaker, which includes a handle, which can indicate an ON position in which the molded case circuit breaker closes a circuit or an OFF position in which the molded case circuit breaker opens the connected circuit, and having a manual operation portion for manually operating the molded case circuit breaker; a lever having one end connected to the handle, rotatable together with pivoting by engagement with the handle, and providing a pivot point to the handle; a pivot shaft connected to another end of the lever so as to provide a pivot point to the lever; a side plate for fixedly supporting the pivot shaft; fixed contactors connected to a power source side or an electrical load side, a movable contactor which is pivotable to a position for contacting the fixed contactors and to a position for being separated from the fixed contactors; a shaft for supporting the movable contactor and providing the rotation driving force to the movable contactor; a pair of shaft driving pins for pivoting by engagement with the shaft so as to simultaneously drive the movable contactors of multi-phases; a lower link having a lower end thereof connected to the shaft so as to provide a rotation driving force to the shaft; an upper link for being connected by engagement with the lower link; a toggle pin for connecting an upper end of the lower link and a lower end of the upper link; a trip spring having both ends each supported by the toggle pin and the handle, charged with an elastic force at the ON position and discharging the elastic force during the trip operation so as to provide the rotation driving force to the shaft; a latch for restricting the trip spring so as to maintain the charged state; a latch holder for being pivotable to a position for restricting the latch and to a position for releasing the latch; and a nail disposed within a pivot track of the latch holder so as to press and pivot the latch holder, the molded case circuit breaker, comprising:

a contact on plate having a lower end thereof connected to one of the pair of the shaft driving pins, and which is vertically movable by being guided according to the pivot movement of the shaft driving pin;

a trip bar pivotably connected to an upper end of the contact on plate, and releasing and pivoting the nail; and a lever pin connected to the lever, and rotating the nail by pressing the trip bar when the handle is manipulated to move to the off position (or reset position) in a state that contacts of the movable contactor and the fixed contactors are melt-adhered to each other in the on position, thereby tripping the molded case circuit breaker, wherein a horizontal position of the toggle pin supporting a lower end of the trip spring should not go beyond the horizontal position of the pivot shaft such that, in a state that the contacts of the movable contactor and the fixed contactors are melt-adhered even though the handle is manipulated to move to the reset position (or off position), an elastic force for automatically rotating the handle toward the on position so as to indicate the conducted state even without having manual force can be provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
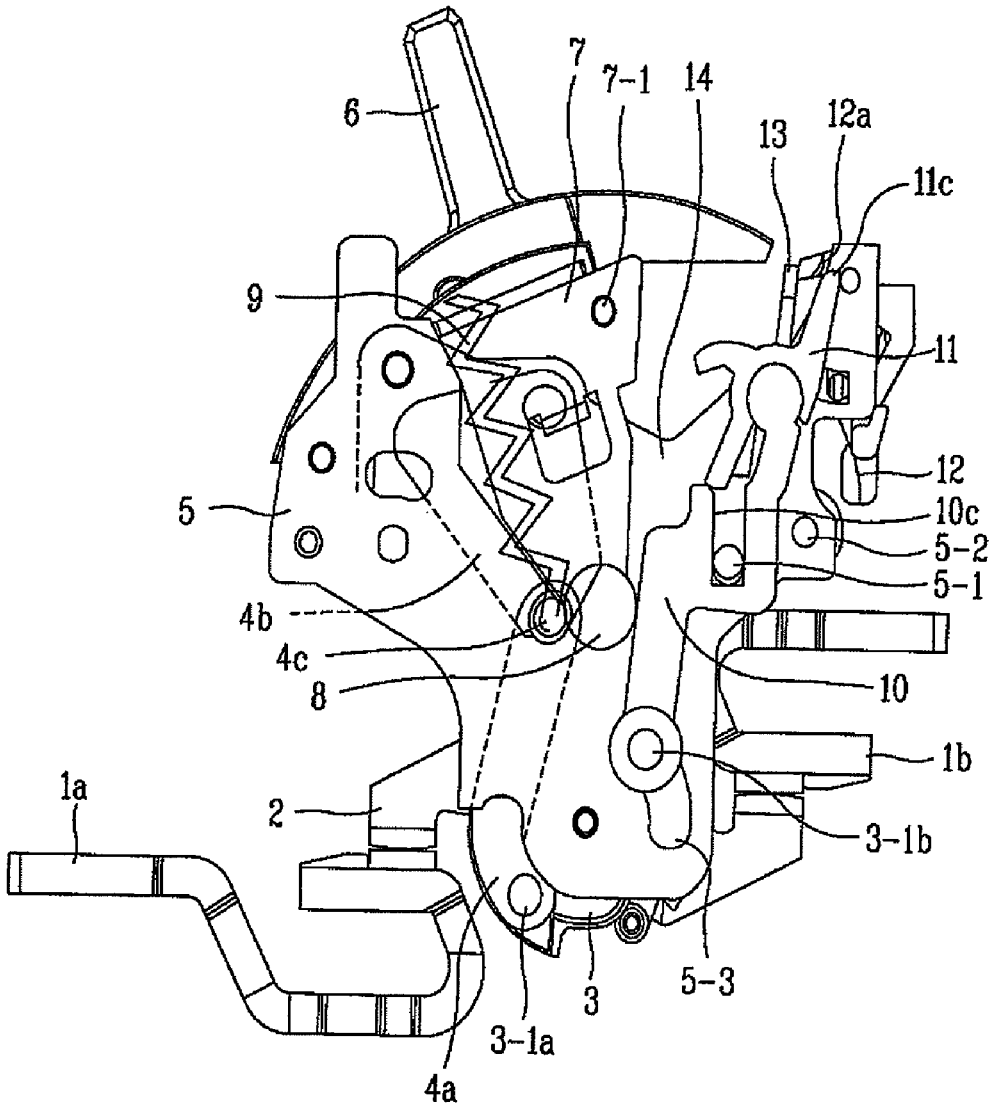
FIG. 1 is a front view illustrating main parts of a molded case circuit breaker having a contact on mechanism according to a first embodiment of the present invention in an ON state when a contact on operation is performed.
Figure 2:
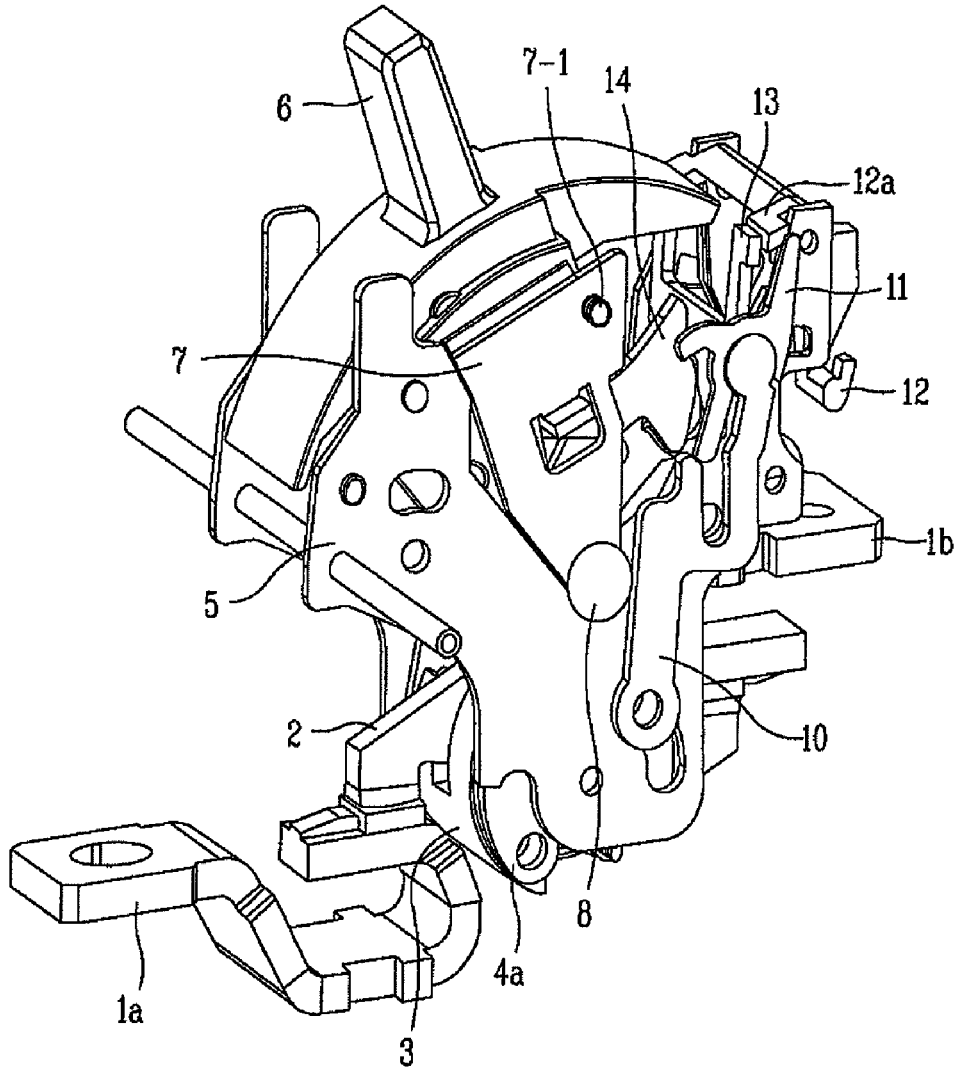
FIG. 2 is a perspective view illustrating the main parts of the molded case circuit breaker having a contact on mechanism according to the first embodiment of the present invention in an ON state when the contact on operation is performed.

FIGS. 1 and 2 are respectively a front view and a perspective view illustrating main parts of a molded case circuit breaker having a contact on mechanism according to a first embodiment of the present invention in an ON state when a contact on operation is performed. Description of a configuration of the molded case circuit breaker and an operation thereof in the ON state according to the first embodiment of the present invention will be given in detail with reference to FIGS. 1 and 2.

The molded case circuit breaker according to the present invention may include, in general, a pair of fixed contactors 1*a* and 1*b*, a movable contactor 2 which is movable to a position for contacting the fixed contactors 1*a*, 1*b* or to a position for being separated from the fixed contactors 1*a*, 1*b*, a switching mechanism (e.g., including 3, 3-1*a*, 3-1*b*, 4*a*, 4*b*, 4*c*, 6, 7, 8, 9) for driving the movable contactor 2 to contact to or be separated from the fixed contactors 1*a*, 1*b* so as to open/close a circuit, a restricting unit (e.g., including 12, 13, 14) for restricting the switching mechanism, and a handle 6 for manually opening/closing the switching mechanism.

The molded case circuit breaker according to the first embodiment of the present invention may include, in particular, a contact on mechanism (e.g., including 7, 7-1, 9, 10, 11), when the handle 6 is manipulated to move to the off position or reset position in a state that the contacts of the movable contactor 2 and the fixed contactors 1*a*, 1*b* are melt-adhered to each other, which trips the switching mechanism by releasing the restriction of the restricting unit and automatically rotates the handle 6 towards the on position, without having manual force, so as to indicate the conducted state.

More specifically, the molded case circuit breaker according to the first embodiment of the present invention may include the handle 6, which can indicate the ON position in which the molded case circuit breaker closes a circuit or the OFF position in which the molded case circuit breaker opens the connected circuit, and providing a manual operation portion for manually operating the molded case circuit breaker.

In addition, the switching mechanism of the molded case circuit breaker according to the first embodiment of the present invention may include the lever 7 having one end connected to the handle 6, pivotable together with the handle 6 by engagement with the handle 6, and providing a pivot point to the handle 6.

In addition, the switching mechanism of the molded case circuit breaker according to the first embodiment of the present invention may include a pivot shaft 8 connected to another end of the lever 7 so as to provide a pivot point to the lever 7, and a side plate 5 for supporting the pivot shaft 8. Here, the pivot shaft 8, for example, may be implemented as a rivet fixedly supported by the side plate.

In addition, the molded case circuit breaker according to the first embodiment of the present invention may include the fixed contactors 1*a*, 1*b* connected to a power source side or an electrical load side, the movable contactor 2 which is pivotable to the position for contacting the fixed contactors 1*a*, 1*b* and to the position for being separated from the fixed contactors 1*a*, 1*b*, the shaft 3 for supporting the movable contactor 2 and providing the rotation driving force to the movable contactor 2, and a pair of shaft driving pins 3-1*a*, 3-1*b* rotatable together with the shaft 3 by engagement with the shaft 3 so as to simultaneously drive the movable contactors 2 for multiphases or poles.

In addition, the switching mechanism of the molded case circuit breaker according to the first embodiment of the present invention may include the lower link 4*a* having a lower end thereof connected to the shaft 3 so as to provide a rotation driving force to the shaft 3, the upper link 4*b* for being connected by engagement with the lower link 4*a*, the toggle pin 4*c* for connecting an upper end of the lower link 4*a* and a lower end of the upper link 4*b*, and the trip spring 9 having both ends each supported by the toggle pin 4*c* and the handle 6, charged with an elastic energy at the ON position and discharging the elastic energy during the trip operation so as to provide the rotation driving force to the shaft 3.

The restricting unit of the molded case circuit breaker according to the first embodiment of the present invention may include the latch 14 for restricting the trip spring 9 so as to maintain the charged state, the latch holder 13 for being pivotable to a position for restricting the latch 14 and to a position for releasing the latch 14, and the nail 12 disposed within a rotating track (a rotating locus) of the latch holder 13 so as to press and pivot the latch holder 13.

The contact on mechanism of the molded case circuit breaker according to the first embodiment of the present invention may include the contact on plate 10 having a lower end thereof connected to one 3-1*b* of the pair of the shaft driving pins 3-1*a*, 3-1*b*, and which is vertically movable by being guided according to the rotation of the shaft driving pin 3-1*b*; the trip bar 11 pivotably connected to an upper end of the contact on plate 10, and for releasing and rotating the nail 12; and the lever pin 7-1 fixed to the lever 7, and for rotating the nail 12 by pressing the trip bar 11 when the handle 6 is manipulated to move to the off position in a state that the contacts of the movable contactor 2 and the fixed contactors 1*a*, 1*b* are melt-adhered to each other at the on position, thereby tripping the molded case circuit breaker.

The lever pin 7-1 may be implemented as a separate pin, or a protruding portion formed by embossing a corresponding position of the lever 7.

In a state that the contacts of the movable contactor 2 and the fixed contactors 1*a*, 1*b* are not separated from each other due to the contact melt-adherence or any other reasons, the user manipulates the handle 6 to move its position to the reset position (or off position). In order to indicate the conducted state of the molded case circuit breaker, an elastic force for automatically rotating the handle 6 towards the on position even in a state the user releases the handle 6 (i.e., without having manual force) should be provided. For this, a horizontal position of the toggle pin 4*c* supporting the lower end of the trip spring 9 should be at the left side of the pivot shaft 8, as shown in FIG. 1, such that it cannot go beyond the horizontal position of the pivot shaft 8.

In order to vertically guide the contact on plate 10 according to the rotation of the shaft driving pin 3-1*b*, the side plate 5 is provided with a guiding elongate hole 5-3 for vertically guiding the shaft driving pin 3-1*b*, and a stopping pin 5-1 protruding to limit an upward movement of the contact on plate 10. The contact on plate 10 is provided with an elongate recess portion 10*c* for surrounding the stopping pin 5-1, and restricting the upward movement of the contact on plate 10 by the stopping pin 5-1.

Meanwhile, description of the construction of the contact on plate 10 and the trip bar 11 according to the first embodiment of the present invention will be given in detail with reference to FIGS. 6 and 7.

Figure 6:
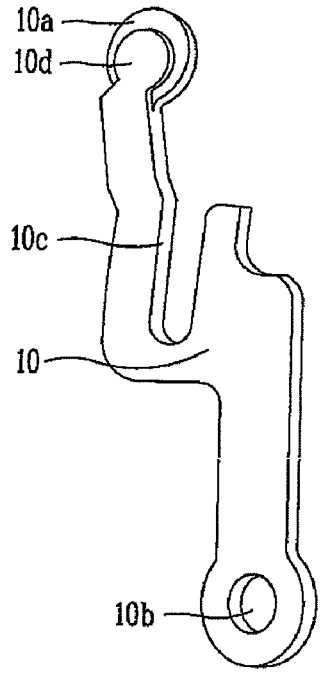
FIG. 6 is a perspective view illustrating a contact on plate as a main part of the contact on mechanism according to the first embodiment of the present invention.
Figure 7:
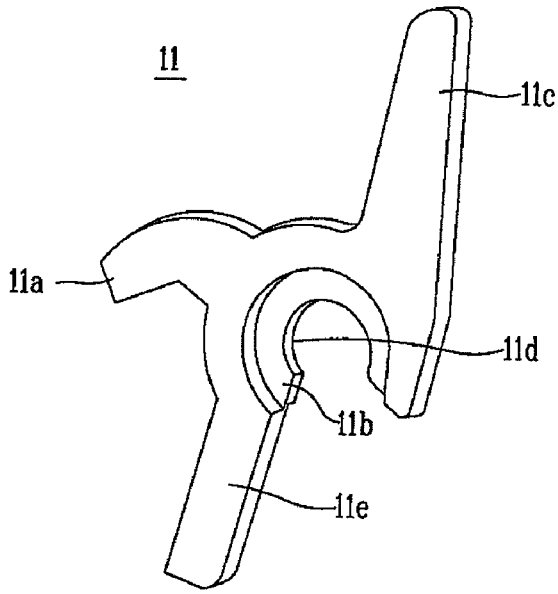
FIG. 7 is a perspective view illustrating a trip bar as a main part of the contact on mechanism according to the first embodiment of the present invention.

As shown in FIG. 6, a boss portion 10*d* serving as the pivot shaft is formed at an upper end of the contact on plate 10, and as shown in FIG. 7, a shaft receiving concaved groove portion 11*d* is formed at the trip bar 11 in correspondence to the boss portion 10*d*, such that the trip bar 11 may perform a pivot movement centering around the upper end of the contact on plate 10.

More specifically, as shown in FIG. 6, a pin hole 10*b* is provided at a lower end of the contact on plate 10 in a lengthwise direction so as to insert the shaft driving pin 3-1*b* of the shaft 3 (FIG. 1) thereto, the elongate recess portion 10*c* is formed to extend from a central portion of the contact on plate 10 in the lengthwise direction. The boss portion 10*d* serving as the pivot shaft of the trip bar 11 so as to pivotably support the trip bar 11, and the flange 10*a* radially extending from the boss portion 10*d* are respectively provided at an upper end of the contact on plate 10 in the lengthwise direction.

As shown in FIG. 7, the shaft receiving concaved groove portion 11*d* for receiving the boss portion 10*d* of the contact on plate 10, and the flange receiving portion 11*b* for receiving the flange 10*a* of the contact on plate 10 are each formed at a central portion of the trip bar 11 in the lengthwise direction. And, the nail restricting portion 11*c* which is pivotable to a position for restricting the nail 12 (FIG. 1) or to a position for releasing the nail 12 is formed to upwardly extend from the central portion of the trip bar 11 in the lengthwise direction. In addition, the trip bar 11 further includes a driving force receiving portion 11*a* for laterally extending from the central portion of the trip bar 11 in the lengthwise direction so as to receive the rotation driving force from the lever pin 7-1 (FIG. 1) of the lever 7 (FIG. 1), and a balancing weight portion 11*e* for downwardly extending from the central portion of the trip bar 11 in the lengthwise direction so as to serve as a balance weight.

Hereinafter, description of the operation of the molded case circuit breaker according to the present invention when the handle is manipulated to the on position from the off position in FIG. 3 will be given in detail with reference to FIGS. 1 and 2.

Figure 3:
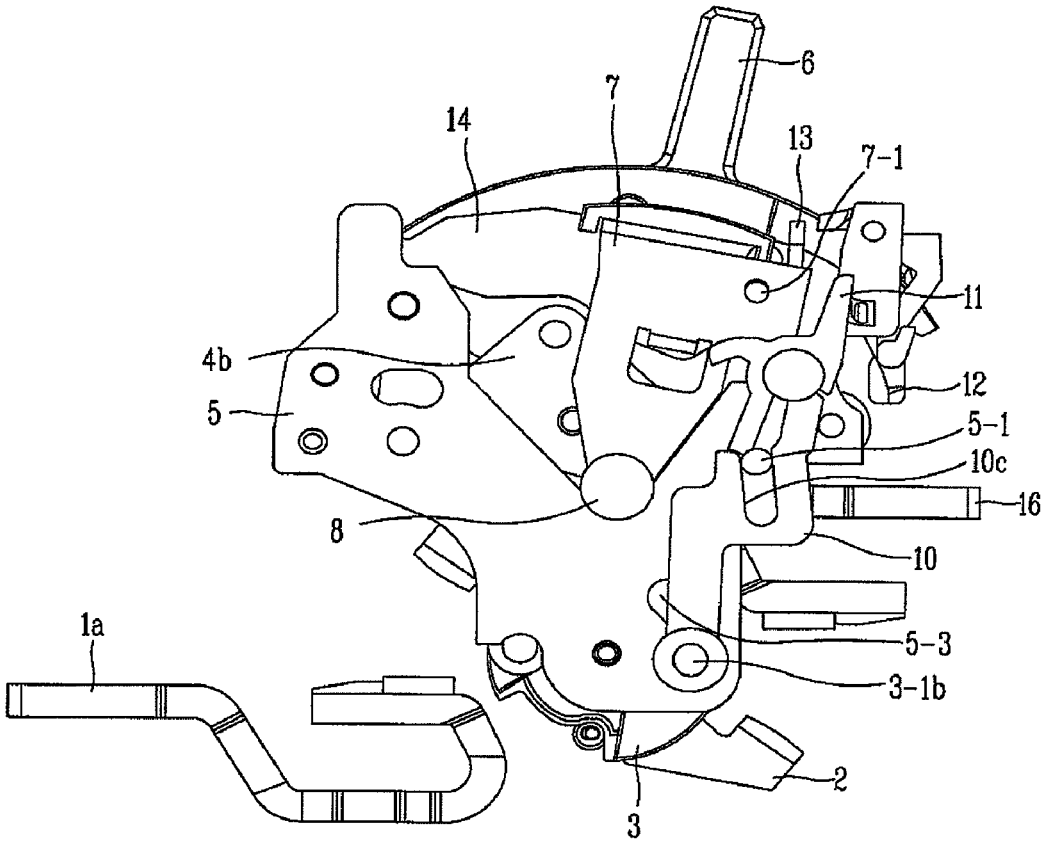
FIG. 3 is a front view illustrating main parts of the molded case circuit breaker having a contact on mechanism in an OFF state according to the first embodiment of the present invention.

In the off position (i.e., reset position) as shown in FIG. 3, if the user manipulates the handle 6 to move its position to the on position by the manual force, the toggle pin 4*c* supporting one end of the trip spring 9 moves downwardly with inclination. Thusly, the trip spring 9 is tensioned and charged with an elastic potential energy.

As the toggle pin 4*c* is moved downwardly with an inclination, the lower link 4*a* and the upper link 4*b* are folded together with a certain internal angle therebetween, as shown in FIG. 1.

Here, as shown in FIG. 1, due to such downward movement of the toggle pin 4*c* with an inclination, the lower link 4*a* moves downwardly, and accordingly, the shaft driving pin 3-1*a* (at the left side in FIG. 1) is rotated in a counter-clockwise direction.

The shaft driving pin 3-1*b* positioned at an opposite side of the shaft 3 in a diametral direction is also rotated in the counter-clockwise direction, thus to be in an ascended position, as shown in FIG. 1.

As the shaft driving pin 3-1*b* is moved to the ascended position, the contact on plate 10 having one end thereof connected to the shaft driving pin 3-1*b* is guided by the guiding elongate hole portion 5-3, the stopping pin 5-1 and the elongate recess portion 10*c*, thus to be vertically moved.

In the reset position (i.e., off position) as shown in FIG. 3, the latch 14 is restricted by the latch holder 13. According to the manipulation of the handle 6 to the on position, the lever 7 is rotated in the counter-clockwise direction (in a left direction in FIG. 1 or 2), and the lever pin 7-1 fixed to the lever 7 is also rotated in the counter-clockwise direction (in the left direction in FIG. 1 or 2). The lever pin 7-1 is spaced (separated) from the trip bar 11.

Here, as the shaft 3 is rotated in the counter-clockwise direction, the movable contactor 2 contacts the fixed contactors 1*a*, 1*b*. Then, the fixed contactors 1*a*, 1*b* are electrically connected to each other, thereby closing the circuit between the power source side and the electrical load side, thus to be in the conducted state.

Meanwhile, the off operation of the molded case circuit breaker having the contact on mechanism according to the first embodiment of the present invention will be described in detail with reference to FIG. 3.

In the on position (FIG. 1) or in the trip position (not shown) where the handle 6 is positioned at a intermediate position between the on and off positions, if the user manipulates the handle 6 to move its position to the off position by the manual force, an upper end portion of the trip spring 9 (shown in FIG. 1) is moved to the right in FIG. 3.

An elastic restoring force for restoring its original shape as a straight line is then applied to the trip spring 9, thereby moving a lower end of the trip spring to the right as shown in the drawing, thus to move the toggle pin 4*c* for supporting the lower end of the trip spring to the right.

As the upper link 4*b* is rotated in the counter-clockwise direction and the lower link 4*a* is rotated in the clockwise-direction, the upper link 4*b* and the lower link 4*a* are folded together with a certain internal angle therebetween. Accordingly, the shaft 3 is rotated in the clockwise-direction, thereby having the off state (breaking the circuit) in which the movable contactor 2 is separated from the fixed contactors 1*a*, 1*b*.

Here, since the latch 14 is restricted by the latch holder 13, the trip spring 9 is tensioned and charged with the elastic potential energy. Accordingly, the toggle pin 4*c* for supporting one end of the tensioned trip spring is moved to the right, while going beyond the pivot shaft 8 of the lever 7.

As the toggle pin is moved to the right, the lower link 4*a* and the upper link 4*b* are more tightly folded together (i.e., with smaller internal angle) than as shown in FIG. 1.

That is, due to the movement of the toggle pin 4*c* to the right, the lower link 4*a* is upwardly moved from the position shown in FIG. 1, and accordingly, the shaft driving pin 3-1*a* (at the left in FIG. 1) is rotated in the clockwise direction.

The shaft driving pin 3-1*b* positioned at an opposite side of the shaft 3 in the diametral direction is also rotated in the clockwise direction, thus to be in a descended position, contrary to as shown in FIG. 1.

As the shaft driving pin 3-1*b* is moved to the descended position, the contact on plate 10 having one end thereof connected to the shaft driving pin 3-1*b* is guided by the guiding elongate hole portion 5-3, the stopping pin 5-1 and the elongate recess portion 10*c*, thus to be downwardly moved.

In the reset position as shown in FIG. 3, the latch 14 is restricted by the latch holder 13. According to the manipulation of the handle 6 to the off position, the lever 7 is rotated in the clockwise direction (in a right direction in FIG. 3), and the lever pin 7-1 fixed to the lever 7 is also rotated in the clockwise direction (in the right direction in FIG. 3). Here, since the contact on plate 10 is downwardly moved, the trip bar 11 connected to the upper end of the contact on plate 10 is also descended, thusly the lever pin 7-1 is spaced (separated) from the trip bar 11 as shown in FIG. 3.

Here, as the shaft 3 is rotated in the clockwise direction, the movable contactor 2 is separated from the fixed contactors 1*a*, 1*b*. Then, the fixed contactors 1*a*, 1*b* are electrically disconnected from each other, thereby opening the circuit between the power source side and the electrical load side, thus to break the circuit.

Meanwhile, description of the contact on operation of the molded case circuit breaker according to the first embodiment of the present invention will be given in detail with reference to FIGS. 4 and 5.

Figure 4:
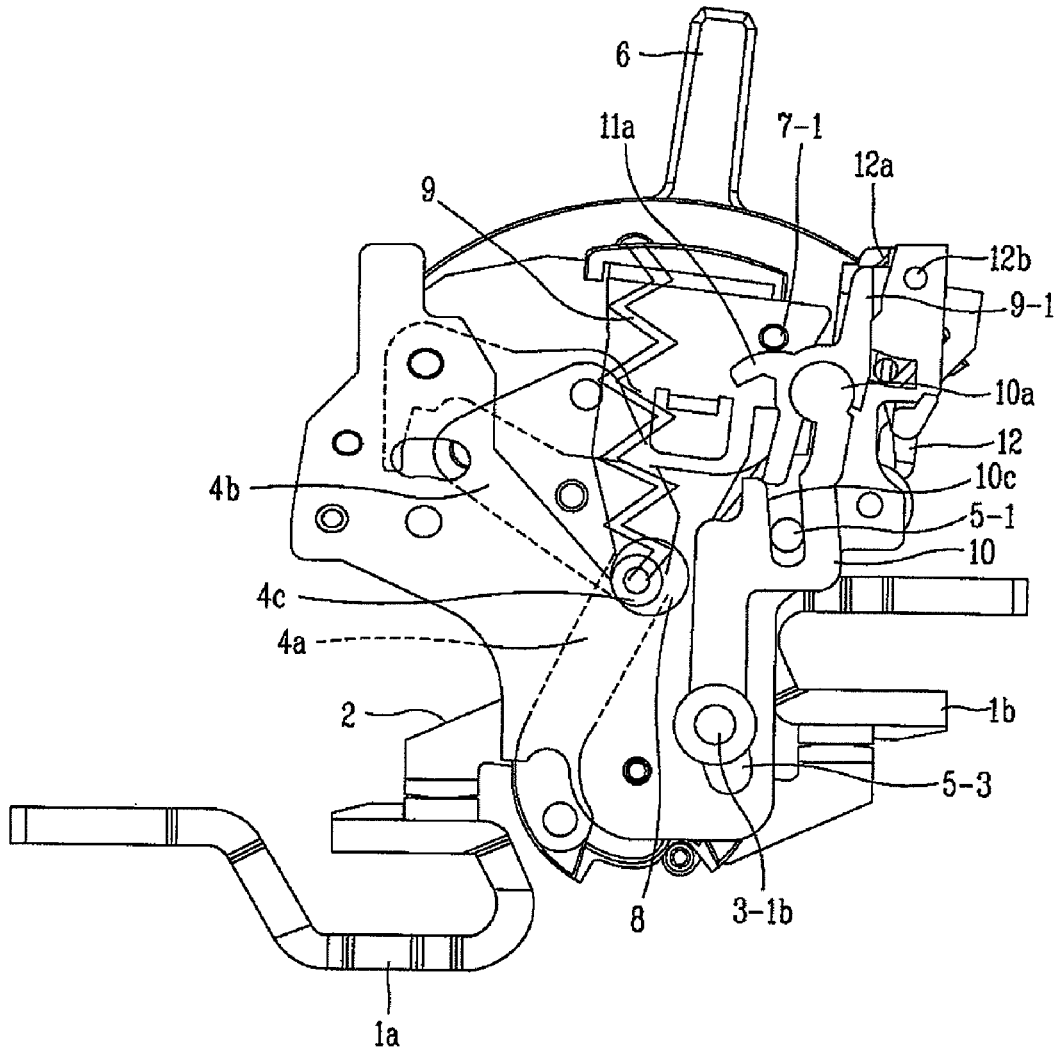
FIG. 4 is a front view of the main parts of the molded case circuit breaker having a contact on mechanism according to the first embodiment of the present invention illustrating when a handle is manipulated to move to the OFF (reset) position before driving the contact on operation in a contact melt-adhered state.

FIG. 4 is a front view of the main parts of the molded case circuit breaker having a contact on mechanism according to the first embodiment of the present invention illustrating the contact on operation in a contact melt-adhered state. FIG. 5 is a perspective view of the main parts of the molded case circuit breaker having a contact on mechanism according to the present invention illustrating the contact on operation in the contact melt-adhered state.

When the molded case circuit breaker according to the first embodiment of the present invention performs a trip operation due to the fault current (e.g., overcurrent, etc.), even though the handle 6 is at the trip position as shown in FIG. 4, the contacts of the movable contactor 2 and the fixed contactors 1*a*, 1*b* are not separated from each other due to the contact melt-adhered state or any other reasons as shown in FIG. 1, thus to be in conducted state. Then, the user may misunderstand that the molded case circuit breaker is in the tripped state, and attempt to switch on the circuit breaker (perform the on manipulation).

Here, in order to switch on the molded case circuit breaker in the tripped state, the handle 6 should be manipulated to move to the off position (reset position) first, and then to the on position.

Accordingly, the user manipulates the handle 6 to move its position to the off position. The lever 7 connected to the handle 6 is pivoted centering around the pivot shaft 8 in the clockwise direction (i.e., to the right in FIGS. 4 and 5) so as to be positioned in the off position, thereby pivoting the lever pin 7-1 fixed to the lever 7 in the clockwise direction (i.e., to the right in FIGS. 4 and 5).

Here, as the contacts of the movable contactor 2 and the fixed contactors 1*a*, 1*b* are in the on state as shown in FIG. 1, the shaft driving pin 3-1*b* (at the right in the drawing) is ascended as well as the contact on plate 10 and the trip bar 11 are ascended. Thusly, the lever pin 7-1 moves to the right, while contacting the driving force receiving portion 11*a* of the trip bar 11.

Figure 5:
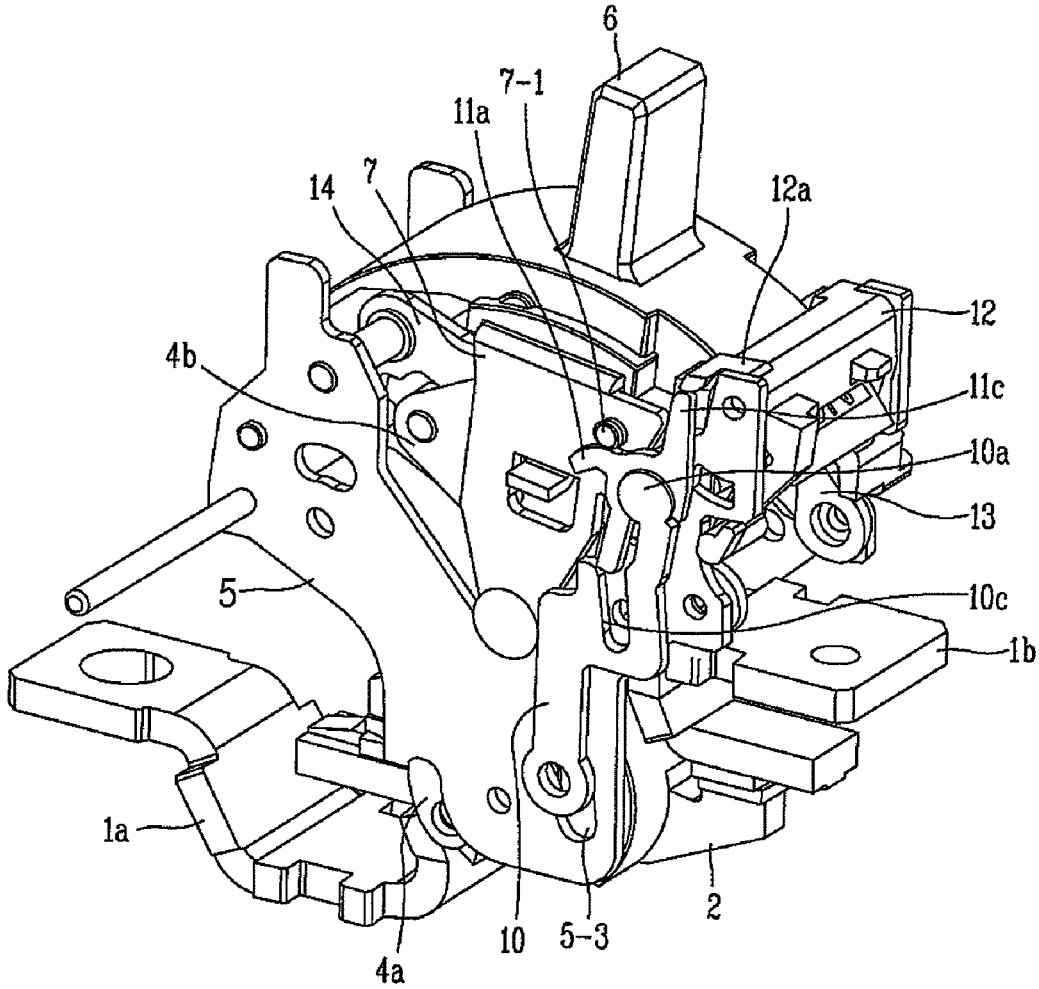
FIG. 5 is a perspective view of the main parts of the molded case circuit breaker having a contact on mechanism according to the first embodiment of the present invention illustrating when the handle is manipulated to move to the OFF position before performing the contact on operation in the contact melt-adhered state.

As shown in FIGS. 4 and 5, the trip bar 11 is rotated in the counter-clockwise direction, and the nail 12 restricted by a lower surface of a restriction receiving portion 12*a* is released by the nail restricting portion 11*c* of the trip bar 11. The nail 12 is rotated centering around a nail pivot shaft 12*b* in the clockwise direction (shown in the drawing) by an elastic force of the spring (not shown) for elastically supporting the nail 12.

Accordingly, while being pressed by the lower end of the pivoting nail 12, the latch holder 13 is rotated centering around a latch holder support shaft (not shown) in the counter-clockwise direction. As the latch holder 13 is rotated, the latch 14 being restricted is released (in a released state if it has already been tripped), thus to perform the trip operation.

In the state that the contacts of the movable contactor 2 and the fixed contactors 1*a*, 1*b* are melt-adhered to each other, if the handle 6 is manipulated to move to the off position, the toggle pin 4*c* maintains the position as shown in FIG. 1 not so as to go beyond the pivot shaft 8 in the horizontal direction (i.e., the toggle pin 4*c* is positioned at the left side of the pivot shaft 8 as shown in FIGS. 1, 4 and 5.).

Accordingly, the upper portion of the trip spring 9 having the lower end supported by the toggle pin 4*c* is bent to the right by the manipulation of the handle 6 to the off position (i.e., to the right in FIGS. 4 and 5). If the handle 6 is released at the off position, the upper portion of the trip spring 9 bent to the right is applied by the elastic recovering force for recovering the straight shape with the left lower portion thereof, thereby automatically moving the handle 6 towards the on position, thus to finish the contact on operation.

The position (state) of the molded case circuit breaker according to the first embodiment of the present invention after the contact on operation is performed is the same as that of the molded case circuit breaker at the on position as shown in FIG. 1 or 2, and detailed explanations therefor are omitted.

According to the first embodiment of the present invention, in the condition that the molded case circuit breaker having the contact on mechanism should be tripped, when the contacts are not separated from each other due to the contact melt-adherence, etc., even though the user attempts to move the handle to the off (reset) position, the reset operation is unable to be performed. If the handle 6 is released, the on position is indicated, thus to notify to the user that the molded case circuit breaker is conducted. Accordingly, the user may appropriately take actions required for safety.

For instance, the user may break any further overcurrent conduction by manipulating a previous stage circuit breaker means such as a main circuit breaker in a previous stage near a power source side, and take actions of separating the molded case circuit breaker, which caused the disorder, from the wiring, replacing, repairing, and the like.

Figure 8:
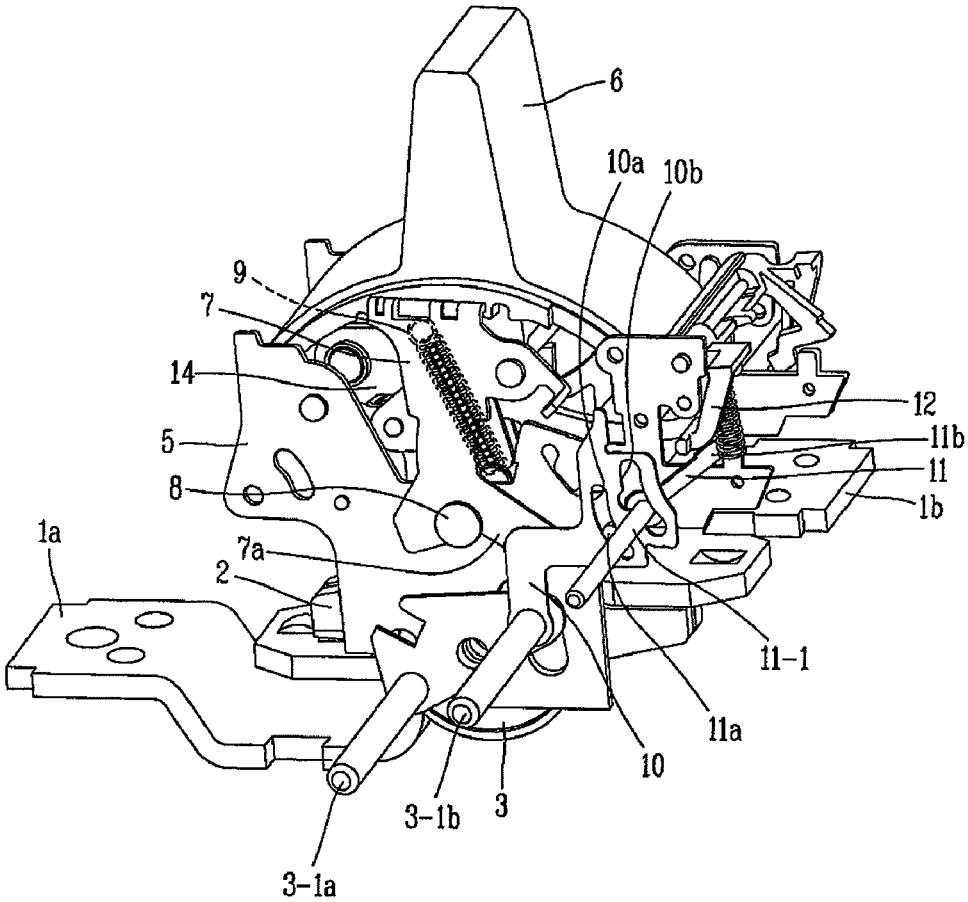
FIG. 8 is a perspective view, seen in an upper right direction, illustrating main parts of a molded case circuit breaker having the contact on mechanism according to a second embodiment of the present invention.
Figure 9:
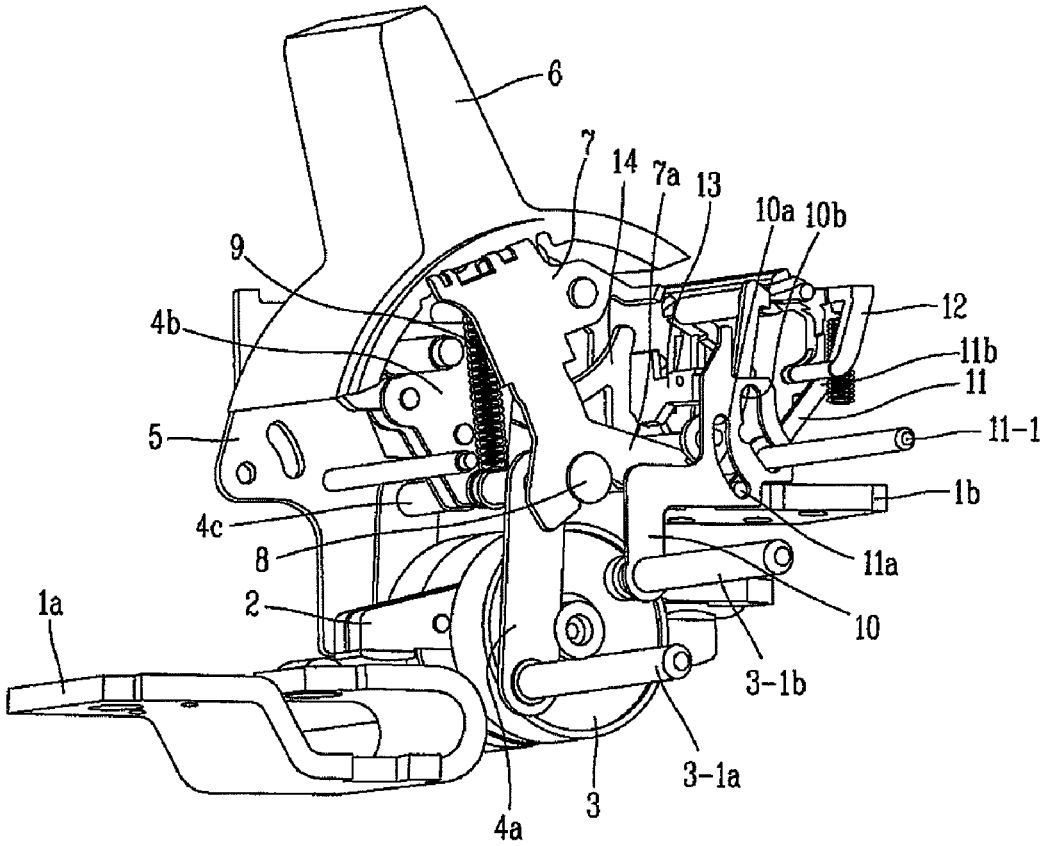
FIG. 9 is a perspective view, seen in a lower left direction, illustrating the main parts of the molded case circuit breaker having the contact on mechanism according to the second embodiment of the present invention.

FIG. 8 is a perspective view, seen in an upper right direction, illustrating main parts of a molded case circuit breaker having a contact on mechanism according to a second embodiment of the present invention. FIG. 9 is a perspective view, seen in a lower left direction, illustrating the main parts of the molded case circuit breaker having the contact on mechanism according to the second embodiment of the present invention. Description of the configuration of the molded case circuit breaker having the contact on mechanism according to the second embodiment of the present invention will be given in detail with reference to FIGS. 8 and 9.

Referring to FIGS. 8 and 9, the molded case circuit breaker according to the present invention may include, as well known parts, a pair of fixed contactors 1*a* and 1*b*, a movable contactor 2 which is movable to a position for contacting the fixed contactors 1*a*, 1*b* and to a position for being separated from the fixed contactors 1*a*, 1*b*, a switching mechanism (e.g., including 3, 3-1*a*, 3-1*b*, 4*a*, 4*b*, 4*c*, 6, 7, 8, 9) for driving the movable contactor 2 to contact or be separated from the fixed contactors 1*a*, 1*b* so as to open/close a circuit, a restricting unit (e.g., including 12, 13, 14) for restricting the switching mechanism, and a handle 6 for manually opening/closing the switching mechanism.

The molded case circuit breaker according to the second embodiment of the present invention may include, as a characterizing element, a contact on mechanism (e.g., including 7, 7-1, 9, 10, 11), when the handle 6 is manipulated to move to the off position or reset position in a state that the contacts of the movable contactor 2 and the fixed contactors 1*a*, 1*b* are melt-adhered to each other, which trips the switching mechanism by releasing the restricting unit and automatically rotates the handle 6 toward the on position, without having manual force, so as to indicate the conducted state.

More specifically, the molded case circuit breaker according to the second embodiment of the present invention may include the handle 6, which can indicate the ON position in which the molded case circuit breaker closes a circuit or the OFF position in which the molded case circuit breaker opens the connected circuit, and for providing a manual operation portion for manually operating the molded case circuit breaker.

In addition, the switching mechanism of the molded case circuit breaker according to the second embodiment of the present invention may include the lever 7 having one end thereof connected to the handle 6, pivoting by engagement with the handle 6, and providing a pivot point to the handle 6.

In addition, the switching mechanism of the molded case circuit breaker according to the second embodiment of the present invention may include a pivot shaft 8 connected to another end of the lever 7 and providing the pivot point of the lever 7, and a side plate 5 for fixing the pivot shaft 8. Here, the pivot shaft 8, for example, may be implemented as a rivet fixed to the side plate.

In addition, the molded case circuit breaker according to the second embodiment of the present invention may include the fixed contactors 1*a*, 1*b* connected to a power source side or an electrical load side, the movable contactor 2 which is pivotable to the position for contacting the fixed contactors 1*a*, 1*b* and to the position for being separated from the fixed contactors 1*a*, 1*b*, the shaft 3 for supporting the movable contactor 2 and for providing the rotation driving force to the movable contactor 2, and a pair of shaft driving pins 3-1*a*, 3-1*b* for rotating by engagement with the shaft 3 so as to simultaneously drive the movable contactors 2 for multi-phases (in other words multi-poles).

In addition, the switching mechanism of the molded case circuit breaker according to the second embodiment of the present invention may include the lower link 4*a* having a lower end thereof connected to the shaft 3 so as to provide a rotation driving force to the shaft 3, the upper link 4*b* connected by engagement with the lower link 4*a*, the toggle pin 4*c* for connecting an upper end of the lower link 4*a* and a lower end of the upper link 4*b*, and the trip spring 9 having both ends each supported by the toggle pin 4*c* and the handle 6, charged with an elastic energy at the on position, and discharging the elastic energy during the trip operation so as to provide the rotation driving force to the shaft 3.

The restricting unit of the molded case circuit breaker according to the second embodiment of the present invention may include the latch 14 for restricting the trip spring 9 so as to maintain the charged state, the latch holder 13 for being pivotable to a position for restricting the latch 14 and to a position for releasing the latch 14, and the nail 12 disposed within a pivot (rotating) track (locus) of the latch holder 13 so as to press and rotate the latch holder 13.

The contact on mechanism of the molded case circuit breaker according to the second embodiment of the present invention may include the contact on plate 10 having a lower end thereof connected to one 3-1*b* of the pair of the shaft driving pins 3-1*a*, 3-1*b*, and which is vertically movable by being guided according to the rotating movement of the shaft driving pin 3-1*b*; the contact on lever 11 pivotably connected at an upper portion of the contact on plate 10 and for driving the restricting unit to a restricting position or to a releasing position; the lever 7 for providing a pivot point of the handle 6; a lever extending portion 7*a* extending from the lever 7 and connected to the contact on plate 10, for rotating the contact on lever 11 by pivoting the contact on plate 10 when manipulating the handle to move to the OFF position in a state that the contacts of the movable contactor and the fixed contactors are melt-adhered to each other in the ON position, thereby moving the restricting unit to the releasing position; and the trip spring 9 having an upper end thereof connected to the handle 6, and for providing an elastic driving force for moving the switching mechanism to the trip position when the restricting unit is moved to the releasing position.

The restricting unit which can drive the contact on lever 11 to the restricting position or the releasing position can be implemented as the nail 12 according to the preferred embodiment. Accordingly, the restricting unit which can drive the lever extending portion 7*a* to the releasing position can also be implemented as the nail 12 according to the preferred embodiment.

When the user manipulates the handle 6 to move its position to the off position (reset position) in a state that the contacts of the movable contactor and the fixed contactors are melt-adhered to each other, the construction for connecting the contact on plate 10 serving to transfer a driving force to pivot the contact on plate 10 and the lever extending portion 7*a* is not shown. However, the contact on plate 10 and the lever extending portion 7*a* may be connected by coupling a concaved groove and a protruding portion, or by a connect pin. Alternatively, the lever extending portion 7*a* may be formed in a shape to be pressed by contacting the contact on plate 10.

In a state that the contacts of the movable contactor 2 and the fixed contactors 1*a*, 1*b* are not separated from each other due to the contact melt-adherence or any other reasons, the user manipulates the handle 6 to move its position to the reset position (or off position). In order to indicate the conducted state of the molded case circuit breaker, an elastic force for automatically pivoting the handle 6 toward the on position (i.e., contact on operation) even in a state the user releases the handle 6 (i.e., without having manual force) should be provided. For this, a horizontal position of the toggle pin 4*c* supporting the lower end of the trip spring 9 should be at the left side of the pivot shaft 8, as shown in FIG. 9, such that it cannot go beyond the horizontal position of the pivot shaft 8.

In order to vertically guide the contact on plate 10 according to the pivot movement of the shaft driving pin 3-1*b*, the side plate 5 is provided with a vertical guiding elongate hole (reference numeral not given) for guiding the shaft driving pin 3-1*b*. And the contact on plate 10 is provided with a first guiding elongate hole portion 10*a* vertically formed to receive a rotation center shaft of the contact on lever 11, and a second guiding elongate hole portion 10*b* for receiving a protruding portion 11*a* of the contact on lever 11 and for transferring a driving force to the contact on lever 11.

The contact on lever 11 may include a nail rotating portion 11*b* disposed at one end of the contact on lever 11 for pressing the nail 12, and a driving force receiving portion 11*a* disposed opposite to the nail rotating portion 11*b* and protruding in an axial direction so as to receive the rotation driving force of the contact on lever 11.

A central portion of the contact on lever 11 in a lengthwise direction is supported by a center pin 11-1 penetratingly formed thereat and fixed to the side plate 5, thereby being rotatable centering around the center pin 11-1.

The first and second guiding elongate hole portions 10*a*, 10*b* of the contact on plate 10 are arc-shaped elongate hole portions, in which a center point of an arc is positioned outside an upper end of the contact on plate 10. With this construction, the respective rotation directions of the contact on plate 10 and the contact on lever 11 are opposite to each other.

Figure 10:
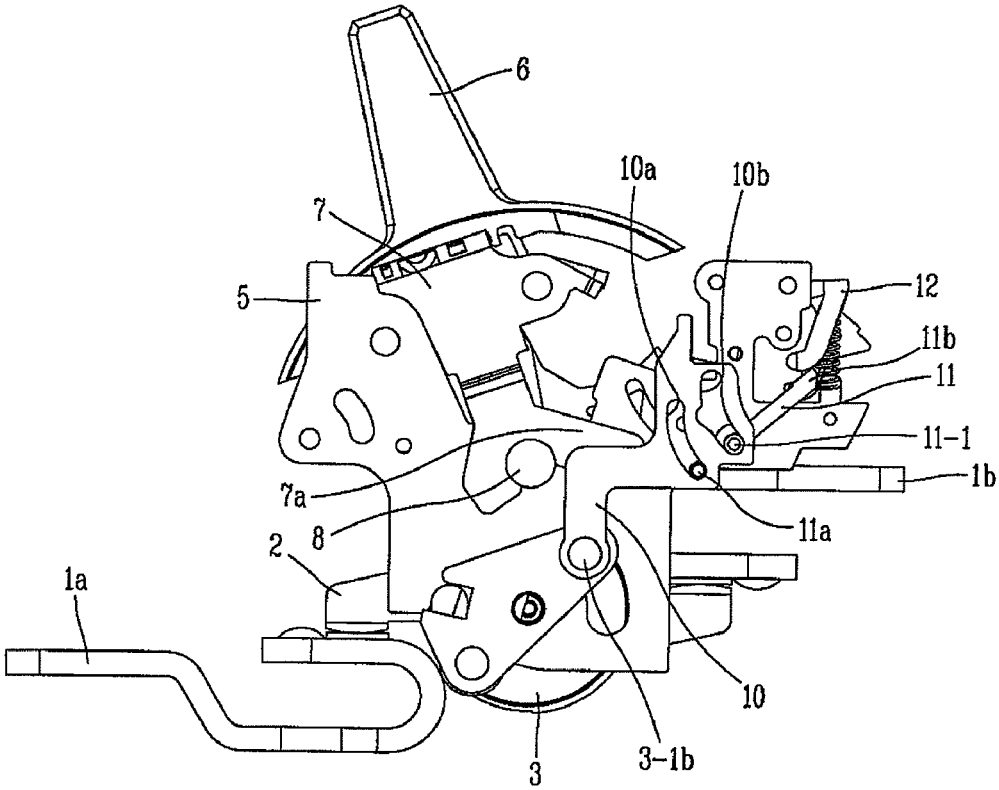
FIG. 10 is a view illustrating an operation state of the main parts of the molded case circuit breaker having a contact on mechanism according to the second embodiment of the present invention in an ON state when the contact on operation is performed.

Meanwhile, description of the on operation of the molded case circuit breaker according to the present invention will be given in detail with reference to FIG. 10. FIG. 10 is a view illustrating an operation state of the main parts of the molded case circuit breaker having a contact on mechanism according to the second embodiment of the present invention in the ON state when a contact on operation is performed.

Figure 11:
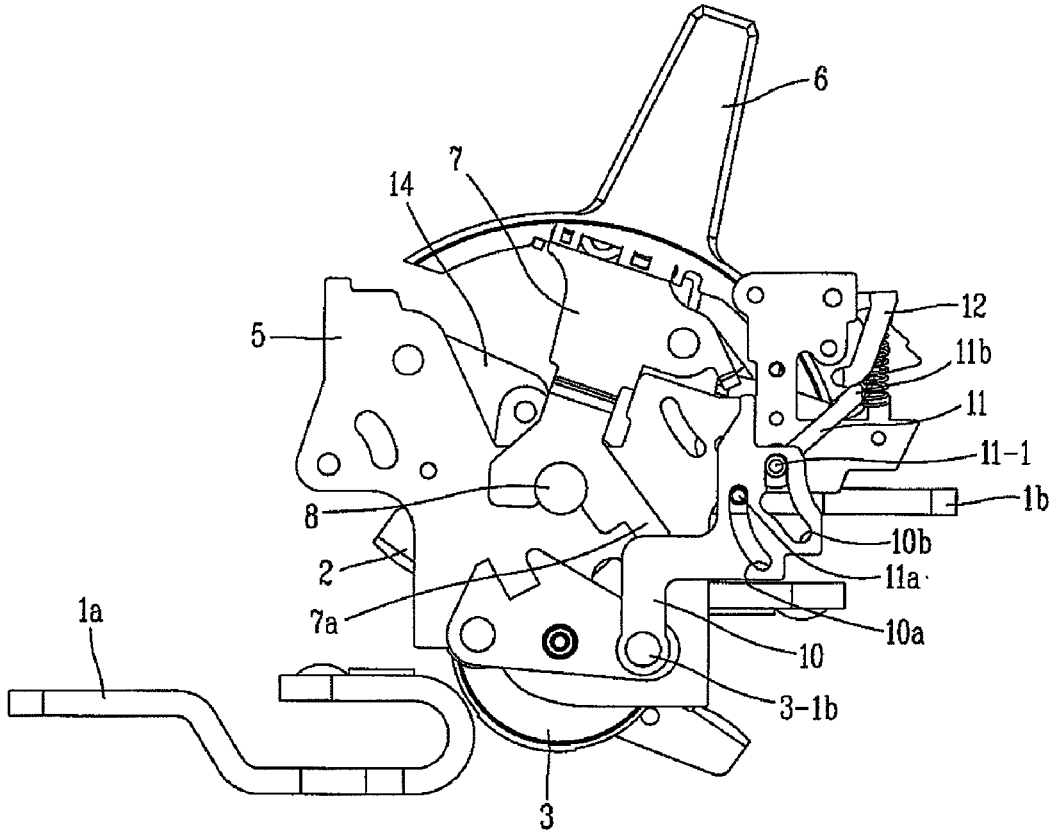
FIG. 11 is a view illustrating an operation state of the main parts of the molded case circuit breaker having a contact on mechanism in an OFF state according to the second embodiment of the present invention.

In the off position as shown in FIG. 11, if the user manipulates the handle 6 to move its position to the on position by manual force as shown in FIG. 10, the toggle pin 4*c* for supporting one end of the tensioned trip spring 9 is downwardly moved with an inclination, thus the trip spring 9 (FIG. 8) is tensioned and charged with an elastic potential energy.

Due to the downward movement of the toggle pin 4*c* with an inclination, the lower link 4*a* and the upper link 4*b* are folded together with a certain internal angle, as shown in FIG. 8.

Here, as the toggle pin 4*c* is downwardly moved with an inclination, the lower link 4*a* is downwardly moved as shown in FIG. 8, and accordingly, the shaft driving pin 3-1*a* (at the left in FIG. 8) is rotated in the counter-clockwise direction.

Then, another shaft driving pin 3-1*b* positioned at an opposite side of the shaft 3 in the diametral direction is also rotated in the counter-clockwise direction, thereby being in an ascended position as shown in FIG. 10.

As the shaft driving pin 3-1*b* is moved to the ascended position, the contact on plate 10 having one end thereof connected to the shaft driving pin 3-1*b* is guided by the guiding elongate hole (reference numeral not given), the center pin 11-1, the first and second guiding elongate hole portions 10*a*, 10*b*, thus to be upwardly moved.

Here, since the contact on plate 10 and the shaft driving pin 3-1*b* are ascended together, the contact on plate 10 is not rotated centering around the shaft driving pin 3-1*b*. Accordingly, the positions of the driving force receiving portion 11*a* and the center pin 11-1 of the contact on lever 11 may be changed to lower end walls of the respective first and second guiding elongate hole portions 10*a*, 10*b* as shown in FIG. 10, from upper end walls thereof as shown in FIG. 11. Thus, the contact on lever 11 is not rotated, and the nail 12 is not driven.

As the shaft 3 is rotated in the counter-clockwise direction, the movable contactor 2 contacts the fixed contactors 1*a*, 1*b*. Accordingly, the fixed contactors 1*a*, 1*b* are electrically connected to each other, thereby closing the circuit between the power source side and the electrical load side, thus to be in a conducted state.

Meanwhile, description of the off operation of the molded case circuit breaker according to the present invention will be given in detail with reference to FIG. 11. FIG. 11 is a view illustrating an operation state of the main parts of the molded case circuit breaker having a contact on mechanism according to the second embodiment of the present invention in the OFF state.

In the on position (FIG. 10) or in the trip position (FIG. 13) where the handle 6 is positioned at an intermediate position between the on and off positions, if the user manipulates the handle 6 to move its position to the off position by the manual force, the upper end portion of the trip spring 9 (shown in FIG. 8) is moved to the right in FIG. 11.

An elastic restoring force for restoring its original shape as a straight line is then applied to the trip spring 9, thereby moving a lower end of the trip spring 9 to the right as shown in the drawing, thus to move the toggle pin 4*c* for supporting the lower end of the trip spring to the right.

As the upper link 4*b* is rotated in the counter-clockwise direction and the lower link 4*a* is rotated in the clockwise-direction, the upper link 4*b* and the lower link 4*a* (in FIG. 8) are folded together with a certain internal angle therebetween. Accordingly, the shaft 3 is rotated in the clockwise-direction, thereby having the off state (circuit breaking) in which the movable contactor 2 is separated from the fixed contactors 1*a*, 1*b*.

Here, since the latch 14 is restricted by the latch holder 13, the trip spring 9 is tensioned and charged with the elastic potential energy. Accordingly, the toggle pin 4*c* for supporting one end of the tensioned trip spring is moved to the right, while going beyond the pivot shaft 8 of the lever 7.

As the toggle pin is moved to the right, the lower link 4*a* and the upper link 4*b* are folded together with a smaller internal angle than as shown in FIG. 8.

That is, due to the movement of the toggle pin 4*c* to the right, the lower link 4*a* is upwardly moved from the position shown in FIG. 8, and accordingly, the shaft driving pin 3-1*a* (at the left in FIG. 8) is rotated in the clockwise direction.

Another shaft driving pin 3-1*b* positioned at an opposite side of the shaft 3 in the diametral direction is also rotated in the clockwise direction, thus to be in a descended position, contrary to as shown in FIG. 8.

As the shaft driving pin 3-1*b* is moved to the descended position as shown in FIG. 11, the contact on plate 10 having one end connected to the shaft driving pin 3-1*b* is guided by the guiding elongate hole 5-3 formed on the side plate 5, the driving force receiving portion 11*a* and the center pin 11-1 of the contact on lever 11, and the first and second guiding elongate hole portions 10*a*, 10*b*, thus to be vertically descended.

Here, since the contact on plate 10 and the shaft driving pin 3-1*b* are descended together, the contact on plate 10 is not rotated centering around the shaft driving pin 3-1*b*. Accordingly, the positions of the driving force receiving portion 11*a* and the center pin 11-1 of the contact on lever 11 may be changed to the upper end walls of the respective first and second guiding elongate hole portions 10*a*, 10*b* as shown in FIG. 11, from the lower end walls thereof as shown in FIG. 10. Thus, the contact on lever 11 is not rotated, and the nail 12 is not driven.

As the shaft 3 is rotated in the clockwise direction, the movable contactor 2 is separated from the fixed contactors 1*a*, 1*b*. Accordingly, the fixed contactors 1*a*, 1*b* are electrically disconnected, thereby opening the circuit between the power source side and the electrical load side, thus to be in the off state (circuit breaking).

Figure 13:
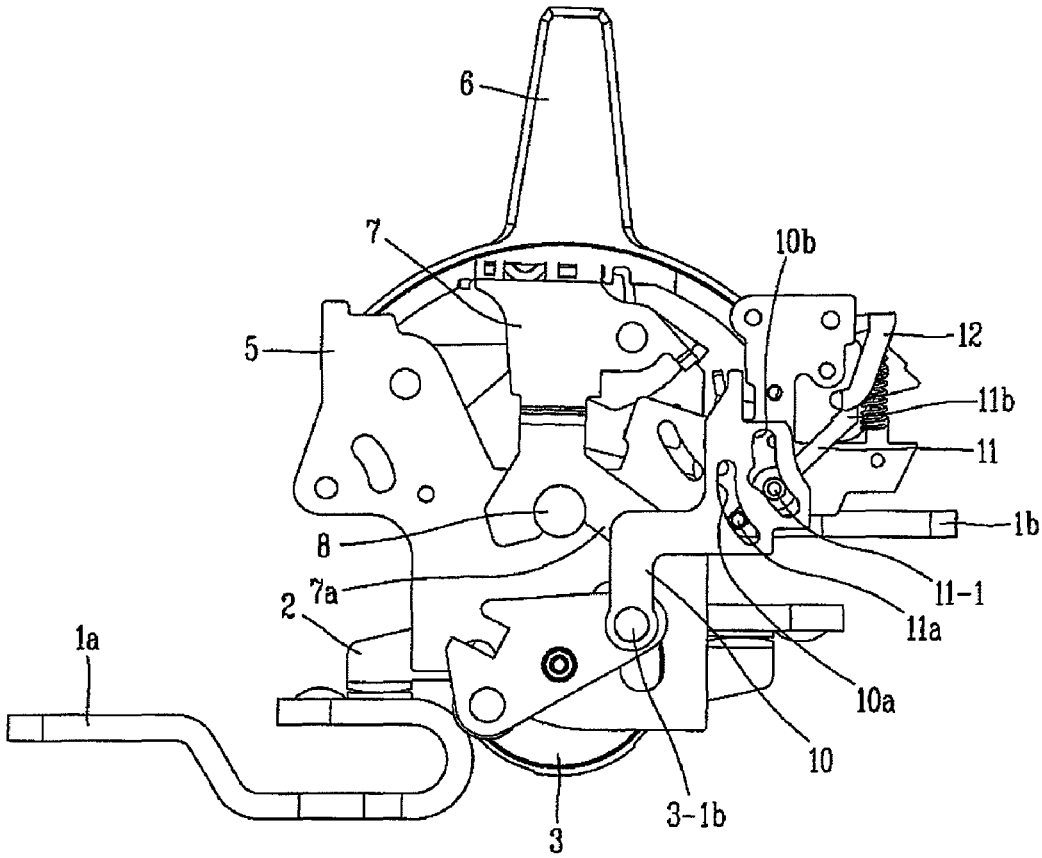
FIG. 13 is a view illustrating an operation state of main parts of a molded case circuit breaker having a contact on mechanism in the abnormal state according to the second embodiment of the present invention.

FIG. 13 is a view illustrating an operation state of the main parts of the molded case circuit breaker in an abnormal state. As shown in FIG. 13, the abnormal state refers to when the contacts of the movable contactor 2 and the fixed contactors 1*a*, 1*b* are melt-adhered to each other since a trip operation attempted responding to a fault current (e.g., short circuit current, etc.) has failed due to the contact melt-adherence or the like, thereby indicating the conducted state, but the handle 6 indicates the trip position (the intermediate position between the on position and the off position).

Meanwhile, in such abnormal state in FIG. 13, when the user attempts to manipulate the handle of the molded case circuit breaker to move to the on position, without exactly knowing the contact position of the molded case circuit breaker, the contact on operation of the molded case circuit breaker according to the present invention will be described in detail with reference to FIG. 12.

Figure 12:
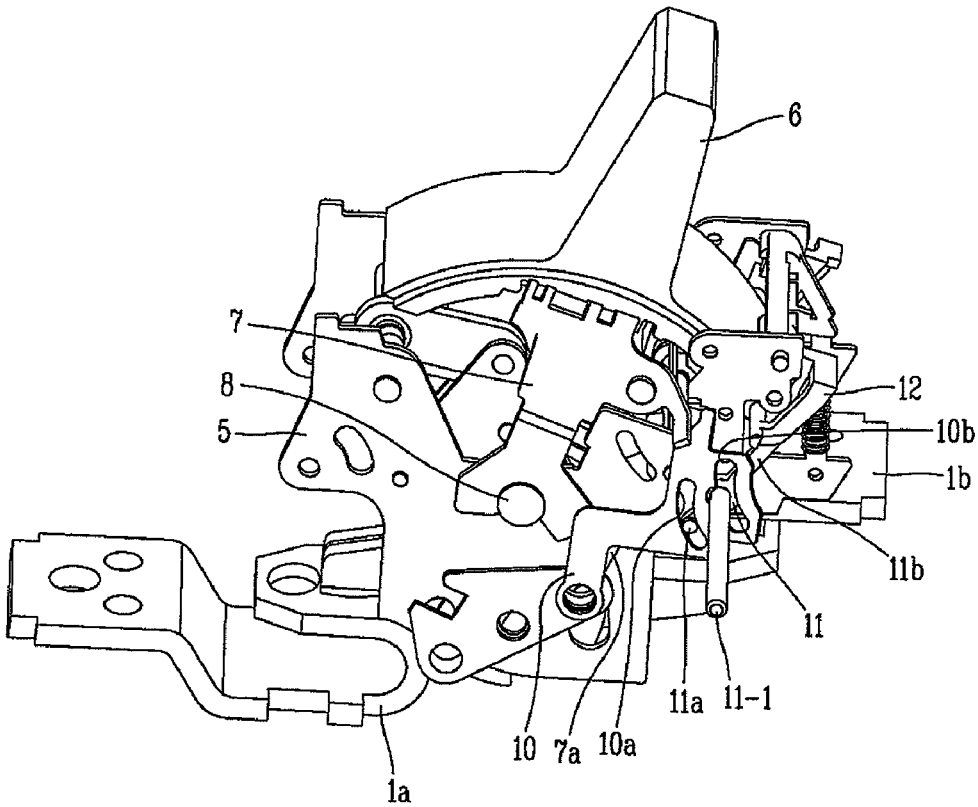
FIG. 12 is a view illustrating an operation state of the main parts of the molded case circuit breaker having a contact on mechanism according to the second embodiment of the present invention when a user manipulates the handle to move its position to the OFF position in an abnormal state.

FIG. 12 is a view illustrating an operation state of the main parts of the molded case circuit breaker having a contact on mechanism according to the present invention when a user manipulates the handle to move its position to the OFF position in an abnormal state.

When the molded case circuit breaker performs the trip operation due to the fault current (e.g., overcurrent, etc.), even though the handle 6 is at the trip position (the intermediate position between the on position and the off position) as shown in FIG. 13, the contacts of the movable contactor 2 and the fixed contactors 1*a*, 1*b* are not separated from each other due to the contact melt-adhered state or any other reasons, similar to the on state (FIG. 10), thus to be in a conducted state. Then, the user may misunderstand that the molded case circuit breaker is in the tripped state and attempt to perform the on operation.

Here, in order to switch on the molded case circuit breaker in the tripped state, the handle 6 should be manipulated to move to the off position (reset position) first, and then to the on position.

Accordingly, the user manipulates the handle 6 to move its position to the off position as shown in FIG. 12. The lever 7 connected to the handle 6 is rotated centering around the pivot shaft 8 in the clockwise direction (i.e., to the right in FIG. 12) so as to be positioned in the off position, thereby pivoting the lever extending portion 7*a* of the lever 7 in the clockwise direction (i.e., to the right in FIG. 12).

Here, as the contacts of each of the movable contactor 2 and the fixed contactors 1*a*, 1*b* are melt-adhered to each other, similar to the on position as shown in FIG. 13, the shaft driving pin 3-1*b* (at the right in the drawing) is ascended as well as the contact on plate 10 is ascended. Thusly, as the lever extending portion 7*a* connected to the contact on plate 10 is rotated in the clockwise direction, the contact on plate 10 is rotated centering around the shaft driving pin 3-1*b* in the clockwise direction.

As shown in FIG. 12, the contact on lever 11 connected to the contact on plate 10 is rotated in the counter-clockwise direction, and the nail rotating portion 11*b* of the contact on lever 11 is rotated in the counter-clockwise direction, thereby pressing and rotating the nail 12 positioned within its rotating locus.

Accordingly, while being pressed by the lower end of the pivoting nail 12, the latch holder 13 is rotated centering around a latch holder support shaft (not shown) in the counter-clockwise direction. As the latch holder 13 is rotated, the latch 14 being restricted (being in a released state if it has already been tripped) is released, thus to perform the trip operation.

In the state that the contacts of the movable contactor 2 and the fixed contactors 1*a*, 1*b* are melt-adhered to each other, if the handle 6 is manipulated to move to the off position (reset position), the toggle pin 4*c* maintains the position as shown in FIG. 9 not so as to go beyond the pivot shaft 8 in the horizontal direction (i.e., the toggle pin 4*c* is positioned at the left side of the pivot shaft 8 as shown in FIG. 9.).

Accordingly, the upper portion of the trip spring 9 having the lower end supported by the toggle pin 4*c* is bent to the right by the manipulation of the handle 6 to the off position (i.e., to the right in FIGS. 11 and 12). If the handle 6 is released at the off position, the upper portion of the trip spring 9 bent to the right is applied by the elastic recovering force for recovering the straight shape with the left lower portion thereof, thereby automatically moving the handle 6 towards the on position, thus the contact on operation is accomplished.

The position (state) of the molded case circuit breaker according to the present invention after the contact on operation is performed is the same as that of the molded case circuit breaker in the on position as shown in FIG. 8, or 9 and 10, and detailed explanations therefor are omitted.

In the condition that the molded case circuit breaker having the contact on mechanism according to the second embodiment of the present invention should be tripped, when the contacts are not separated from each other due to the contact melt-adherence, etc., even though the user attempts to move the handle to the reset position, the reset operation is unable to be performed. If the handle 6 is released, the on position is indicated, thus to notify to the user that the molded case circuit breaker is conducted. Accordingly, the user may appropriately take actions required for safety.

For instance, the user may block any further overcurrent conduction by manipulating a pre-stage circuit breaker means such as a main circuit breaker in a pre-stage, and take actions of separating the molded case circuit breaker, which caused the disorder, from the wiring, replacing, repairing, and the like.

Accordingly, when the user approaches and manipulates the molded case circuit breaker, the handle is at the on position or a position towards the on position indicating that the circuit is conducted, thereby preventing electric accidents which may occur, thus to protect a load equipment and a human life.

Description of the configuration and operation of the molded case circuit breaker having a contact on mechanism according to a third embodiment of the present invention will be given in detail with reference to FIGS. 14 and 18.

Figure 14:
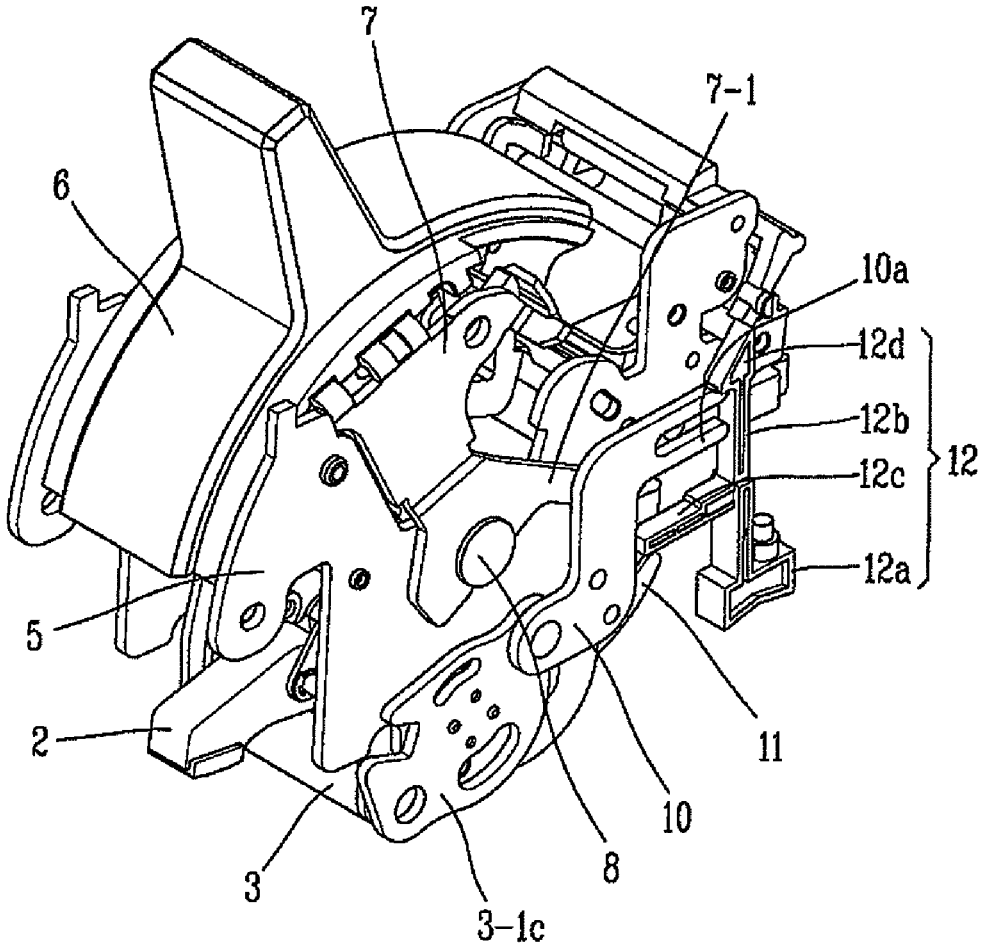
FIG. 14 is a perspective view illustrating a construction of the main parts of a molded case circuit breaker having a contact on mechanism according to the third embodiment of the present invention.
Figure 15:
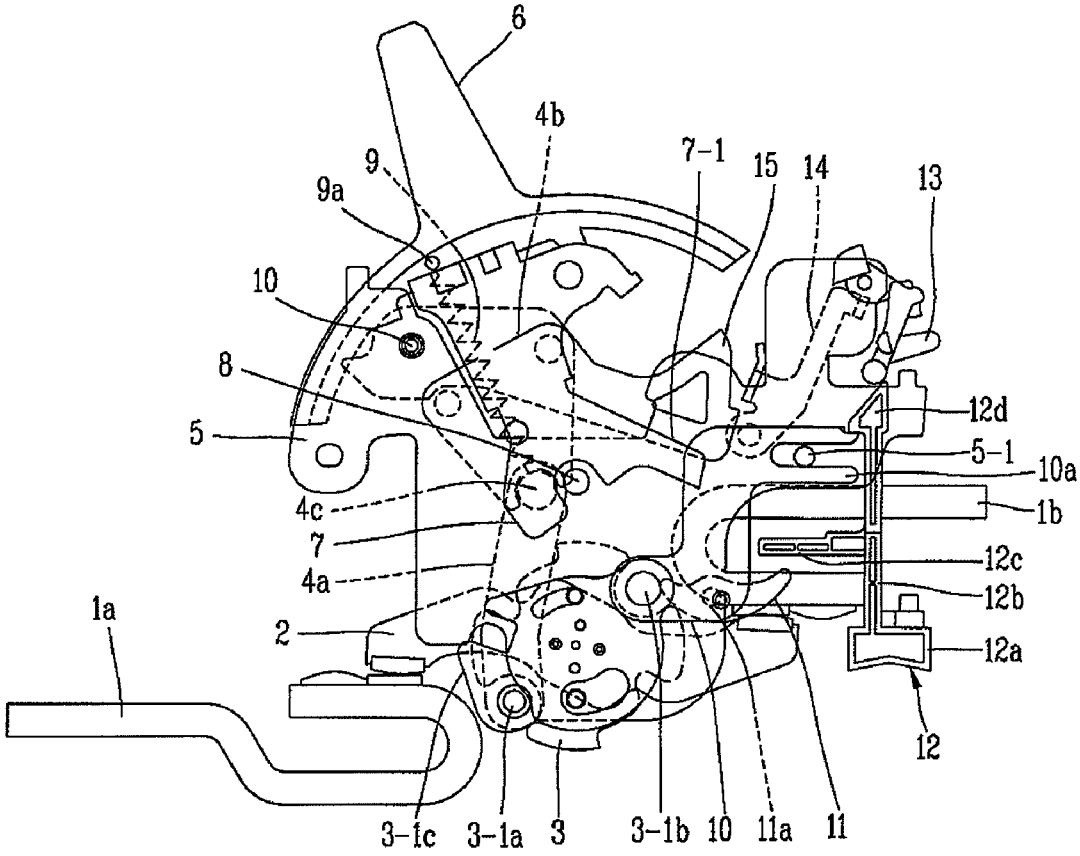
FIG. 15 is a view illustrating an operation state of the main parts of the molded case circuit breaker having a contact on mechanism in an ON state according to the third embodiment of the present invention.

FIGS. 14 and 15 are respectively a perspective view and a front view illustrating a construction of the main parts, in an ON state, of the molded case circuit breaker having a contact on mechanism according to the third embodiment of the present invention.

Description of the construction of the molded case circuit breaker and the operation thereof in the on state will be given in detail with reference to FIGS. 14 and 15.

The molded case circuit breaker according to the third embodiment of the present invention may include, in general, a pair of fixed contactors 1*a* and 1*b*, a movable contactor 2 which is movable to a position for contacting the fixed contactors 1*a*, 1*b* and to a position for being separated from the fixed contactors 1*a*, 1*b*, a switching mechanism (e.g., including 3, 3-1*a*, 3-1*b*, 4*a*, 4*b*, 4*c*, 6, 7, 8, 9) for driving the movable contactor 2 to contact or be separated from the fixed contactors 1*a*, 1*b* so as to open/close a circuit, a restricting unit (e.g., including 13, 14, 15) for restricting the switching mechanism, and a handle 6 for manually opening/closing the switching mechanism.

The molded case circuit breaker according to the third embodiment of the present invention may include, in particular, a contact on mechanism (e.g., including 7-1, 9, 10, 11, 12), when the handle 6 is manipulated to move to the off position or reset position in a state that the contacts of the movable contactor 2 and the fixed contactors 1*a*, 1*b* are melt-adhered to each other, which trips the switching mechanism by releasing the restricting unit and automatically pivots the handle 6 toward the on position, without having the manual force, so as to indicate the conducted state.

More specifically, the molded case circuit breaker according to the third embodiment of the present invention may include the handle 6, which can indicate the ON position in which the molded case circuit breaker closes a circuit or the OFF position in which the molded case circuit breaker opens the connected circuit, and providing a manual operation portion for manually operating the molded case circuit breaker.

In addition, the switching mechanism of the molded case circuit breaker according to the third embodiment of the present invention may include the lever 7 having one end connected to the handle 6, pivotable by engagement with the handle 6, and providing a pivot point to the handle 6.

In addition, the switching mechanism of the molded case circuit breaker according to the third embodiment of the present invention may include a pivot shaft 8 connected to another end of the lever 7 and providing the pivot point of the lever 7, and a side plate 5 for fixedly supporting the pivot shaft 8. Here, the pivot shaft 8, for example, may be implemented as a rivet fixed to the side plate.

In addition, the molded case circuit breaker according to the third embodiment of the present invention may include the fixed contactors 1*a*, 1*b* connected to a power source side or a electrical load side, the movable contactor 2 which is movable to the position for contacting the fixed contactors 1*a*, 1*b* and to the position for being separated from the fixed contactors 1*a*, 1*b*, the shaft 3 for supporting the movable contactor 2 and providing the rotation driving force to the movable contactor 2, and a pair of shaft driving pins 3-1*a*, 3-1*b* for pivoting by engagement with the shaft 3 so as to simultaneously drive the movable contactors 2 of multi-phases or poles.

In addition, the switching mechanism of the molded case circuit breaker according to the third embodiment of the present invention may include the lower link 4*a* having a lower end thereof connected to the shaft 3 so as to provide a rotation driving force to the shaft 3, the upper link 4*b* for being connected by engagement with the lower link 4*a*, the toggle pin 4*c* for connecting an upper end of the lower link 4*a* and a lower end of the upper link 4*b*, and the trip spring 9 having both ends each supported by the toggle pin 4*c* and the handle 6, charged with an elastic energy in the on position, and discharging the elastic energy during the trip operation so as to provide the rotation driving force to the shaft 3.

The restricting unit of the molded case circuit breaker according to the third embodiment of the present invention may include the latch 15 for restricting the trip spring 9 to maintain the charged state, the latch holder 14 for being pivotable to a position for restricting the latch 15 and to a position for releasing the latch 15, and the nail 13 disposed within a rotating locus of the latch holder 14 so as to press and pivot the latch holder 14.

The contact on mechanism of the molded case circuit breaker according to the third embodiment of the present invention may include the shooter 12 for pressing the restricting unit thereby moving it to the releasing position when vertically moved;

the contact on plate 10 connected to the switching mechanism, and which is movable in up/down directions by being guided according to an operation of the switching mechanism;

the contact on lever 11 rotatably supported by the contact on plate 10, for pressing the shooter thereby providing a driving force for the shooter to vertically move when rotated;

the lever extending portion 7-1 extending from the lever 7, and upwardly moving the shooter 12 so as to drive the restricting unit to the releasing position by pressing and rotating the contact on lever 11 when the handle 6 is manipulated to move to the off position (or reset position) in a state that the contacts of the movable contactor 2 and the fixed contactors 1*a*, 1*b* are melt-adhered to each other in the on position; and the trip spring 9 having an upper end thereof connected to the handle 6, and providing an elastic driving force for moving the switching mechanism to the trip position when the restricting unit is moved to the releasing position.

In a state that the contacts of the movable contactor 2 and the fixed contactors 1*a*, 1*b* are not separated from each other due to the contact melt-adherence or any other reasons, the user manipulates the handle 6 to move its position to the reset position (or off position). In order to indicate the conducted state of the molded case circuit breaker, an elastic force for automatically pivoting the handle 6 toward the on position even in a state the user releases the handle 6 (i.e., without having manual force) should be provided. For this, a horizontal position of the toggle pin 4*c* supporting the lower end of the trip spring 9 should be at the left side of the pivot shaft 8, as shown in FIG. 15, such that it cannot go beyond the horizontal position of the pivot shaft 8.

In order to vertically guide the contact on plate 10 according to the pivot movement of the shaft driving pin 3-1*b*, the contact on plate 10 is formed to have an "S" shape. A lower portion of the contact on plate 10 is connected to one shaft driving pin 3-1*b* of a pair of shaft driving pins 3-1*a*, 3-1*b*. A guiding recess portion 10*a* is formed at an upper portion of the contact on plate 10 in a horizontal direction. A support pin 5-1 inserted into the guiding recess portion 10*a* of the contact on plate 10 is fixedly provided at an upper right side (shown in the drawing) of the side plate 5 so as to support the upper portion of the contact on plate 10.

The contact on lever 11 is rotatably supported by a pivot shaft or pivot support pin (reference numeral not given) fixed to the contact on plate 10. In this embodiment, the contact on lever 11 is a member formed to have an approximately crescent shape, and includes a driving force receiving portion for rotating centering around the pivot shaft and receiving a rotation driving force from the lever extending portion 7-1, and a driving force transferring portion for transferring a driving force to upwardly move to the driving force receiving portion 12*c* of the shooter 12 by rotation. In addition, the contact on lever 11 may be positioned to be contacted within a rotating locus of the lever extending portion 7-1 in order to receive the rotation driving force from the lever extending portion 7-1. However, whether or not the contact on lever 11 is contacted by the lever extending portion 7-1 is determined by the position of the contact on plate 10 supporting the contact on lever 11.

Such relative positions and operations of the lever extending portion 7-1, the contact on plate 10 and the contact on lever 11 will be better understood by the following explanations of the on, off, trip and contact on operations of the molded case circuit breaker of the present invention.

Meanwhile, the shooter 12 which is vertically movable and rotates the nail 13 by pressing is a member having an approximately bar shape, and includes a driving force receiving portion 12*c* extending within the rotating locus of one end of the contact on lever 11. The shooter 12 may include a base portion 12*a*, a body portion 12*b* upwardly extending from the base portion 12*a*, the driving force receiving portion 12*c* horizontally extending from a central portion of the body portion 12*b* in the lengthwise direction so as to be within the rotating locus of the one end of the contact on lever 11, and a nail driving portion 12*d* disposed at an uppermost end of the body portion 12*b*, and having a sharp fore-end and an inclined surface contacting the nail 13 so as to rotate the nail 13.

A shooter having such shapes and configuration, and its construction to guide and support a vertical movement of such shooter may be described with reference to the shooter which disclosed in Korean Patent No. 10-0574423 (Title of the invention: a circuit breaker having a pressure trip device) filed on Oct. 7, 2004 in Korea, registered on Apr. 20, 2006 by the applicant of the present invention. The cited shooter is guided to be vertically movable between outer walls of the two adjacent single pole breaking units for each electrical pole (the main parts shown in FIGS. 1 through 5 are built within the insulation case so as to form the separate breaking unit for each of poles) by a pressure of an arc gas generating when the contacts are separated. Such gas pressure shooter may also be applied as the shooter for the contact on operation in the present invention.

Figure 16:
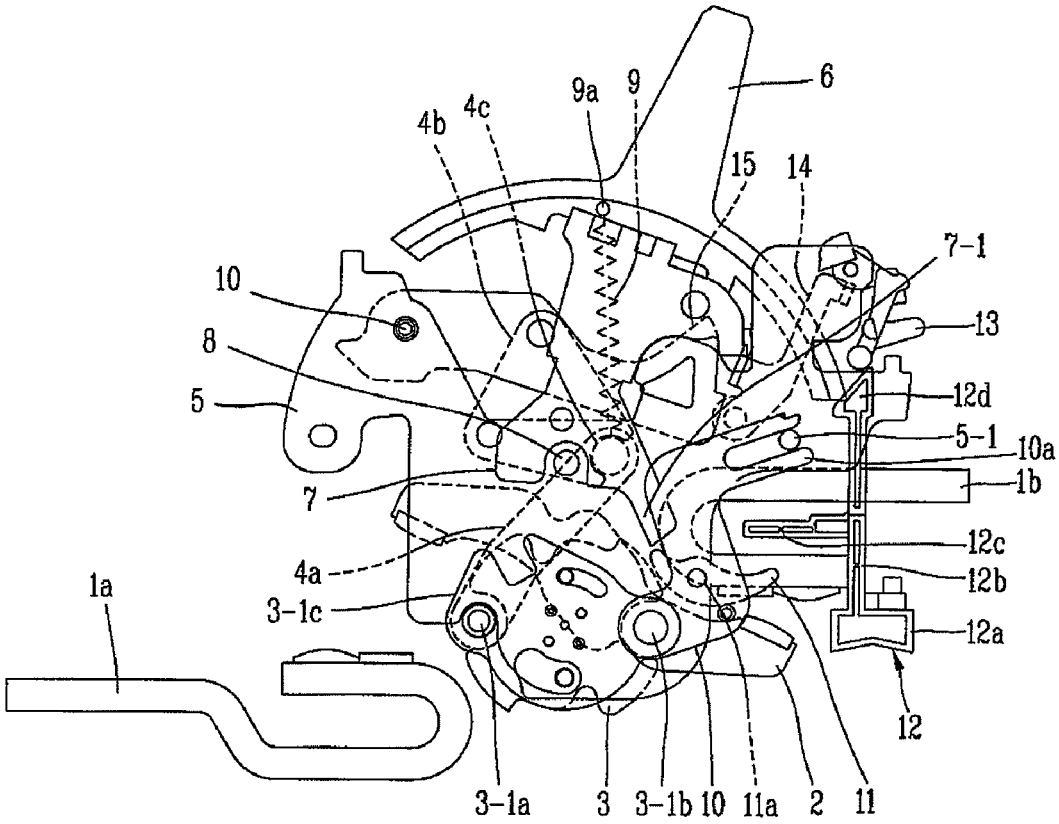
FIG. 16 is a view illustrating an operation state of the main parts of the molded case circuit breaker having a contact on mechanism in an OFF state according to the third embodiment of the present invention.

Description of the operation of the molded case circuit breaker according to the present invention when the handle is manipulated to move from the off position to the on position as shown in FIG. 16 will be given in detail with reference to FIG. 15.

As shown in FIG. 16, if the user manipulates the handle 6 to move its position from the off position (or reset position) to the on position by the manual force, the toggle pin 4*c* supporting one end of the trip spring 9 is downwardly moved with an inclination. Accordingly, the trip spring 9 is tensioned and charged with an elastic potential energy.

As the toggle pin 4*c* is moved downwardly with an inclination, the lower link 4*a* and the upper link 4*b* are folded together with a certain internal angle therebetween as shown in FIG. 15.

Here, as shown in FIG. 15, due to such downward movement of the toggle pin 4*c* with an inclination, the lower link 4*a* moves downwardly, and accordingly, the shaft driving pin 3-1*a* (at the left in FIG. 15) is rotated in the counter-clockwise direction.

Another shaft driving pin 3-1*b* positioned at an opposite side of the shaft 3 in the diametral direction is also rotated in the counter-clockwise direction, thus to be in an ascended position, as shown in FIG. 15.

As the shaft driving pin 3-1*b* is moved to the ascended position, the contact on plate 10 having one end thereof connected to the shaft driving pin 3-1*b* is guided by the guiding recess portion 10*a* and the stopping pin 5-1, thus to be upwardly moved and then stopped.

In the reset position as shown in FIG. 16, the latch 14 is restricted by the latch holder 13. According to the manipulation of the handle 6 to the on position, the lever 7 is rotated in the counter-clockwise direction (in the left direction in FIG. 15), and the lever extending portion 7-1 of the lever 7 is also rotated in the counter-clockwise direction (in the left direction in FIG. 15). Accordingly, the lever extending portion 7-1 is spaced (separated) from the contact on lever 11, thereby not contacting each other.

Here, as the shaft 3 is rotated in the counter-clockwise direction, the movable contactor 2 contacts the fixed contactors 1*a*, 1*b*. Then, the fixed contactors 1*a*, 1*b* are electrically connected, thereby closing the circuit between the power source side and the electrical load side, thus to be in the conducted state.

Meanwhile, the off operation of the molded case circuit breaker having the contact on mechanism according to the present invention will be described in detail with reference to FIG. 16.

In the on position (FIG. 15) or in the trip position (FIG. 17) where the handle 6 is positioned between the on and off positions, if the user manipulates the handle 6 to move its position to the off position by the manual force, an upper end portion of the trip spring 9 fixed to the handle 6 is moved to the right in FIG. 16.

An elastic restoring force for restoring an original shape as a straight line is then applied to the trip spring 9, thereby moving a lower end of the trip spring to the right as shown in the drawing, thus to move the toggle pin 4*c* for supporting the lower end of the trip spring to the right.

As the upper link 4*b* is rotated in the counter-clockwise direction and the lower link 4*a* is rotated in the clockwise-direction, the upper link 4*b* and the lower link 4*a* are folded together with a certain internal angle therebetween. Accordingly, the shaft 3 is rotated in the clockwise-direction, thereby having the off state (circuit breaking) in which the movable contactor 2 is separated from the fixed contactors 1*a*, 1*b*.

Here, since the latch 14 is restricted by the latch holder 13, the trip spring 9 is restricted by being tensioned, so that the elastic potential energy charged status of the trip spring 9 is maintained.

As the toggle pin 4*c* is moved to the right, an internal angle between the lower link 4*a* and the upper link 4*b* is becomes much smaller than as shown in FIG. 2 (i.e., the lower and upper links 4*a*, 4*b* are tightly folded).

That is, due to the movement of the toggle pin 4*c* to the right, the lower link 4*a* is upwardly moved from the position shown in FIG. 15, and accordingly, the shaft driving pin 3-1*a* (at the left in FIG. 16) is rotated in the clockwise direction.

Another shaft driving pin 3-1*b* positioned at an opposite side of the shaft 3 in the diametral direction is also rotated in the clockwise direction, thus to be in a descended position as shown in FIG. 16, contrary to as shown in FIG. 15.

As the shaft driving pin 3-1*b* is moved to the descended position, the contact on plate 10 having one end thereof connected to the shaft driving pin 3-1*b* is guided by the stopping pin 5-1 and the guiding recess portion 10*a* fixed to the side plate 5, thus to be slantly descended.

In the reset position as shown in FIG. 16, the latch 14 is restricted by the latch holder 13. According to the manipulation of the handle 6 to the off position, the lever 7 is rotated in the clockwise direction (in the right direction in FIG. 16), and the lever extending portion 7-1 fixed to the lever 7 is also rotated in the clockwise direction (in the right direction in FIG. 16). Here, since the contact on plate 10 is downwardly moved, the contact on lever 11 having the pivot shaft thereof fixed to the contact on plate 10 is also descended. Accordingly, the lever extending portion 7-1 is spaced (separated) from the contact on lever 11 as shown in FIG. 16.

Here, as the shaft 3 is rotated in the clockwise direction, the movable contactor 2 supported by the shaft 3 is also rotated in the clockwise direction, thereby being separated from the fixed contactors 1*a*, 1*b*. Then, the fixed contactors 1*a*, 1*b* are electrically disconnected, thereby opening the circuit between the power source side and the electrical load side, thus to break the circuit.

Meanwhile, description of the trip operation of the molded case circuit breaker according to the present invention will be given in detail with reference to FIG. 17.

If a large current flows in the electrical line due to a short circuit fault or the like, an electromagnetic repulsive force is generated between the movable contactor 2 and the fixed contactors 1*a*, 1*b*, thereby pivoting the movable contactor 2 by being separated from the fixed contactors 1*a*, 1*b*, thus to generate an arc. An arc gas formed by the generated arc and surrounding air is discharged through an outlet (not shown) by a momentarily great pressure. The shooter 12 having a lower portion disposed to communicate with the outlet is lifted by the arc gas pressure, thereby rotating the nail 13. Accordingly, as the latch holder 14 rotated by the rotation of the nail 13 is released from its restriction, the trip spring 9 discharges the charged elastic potential energy, thereby being contracted to be its original state. The toggle pin 4*c* for supporting the lower end of the trip spring 9 is upwardly lifted. The lower link 4*a* is rotated in the clockwise direction and the upper link 4*b* is rotated in the counter-clockwise direction. The latch 15 connected by engagement with the upper link 4*b* is rotated in the counter-clockwise direction by the shaft or pin (reference numeral not given, but referring to the uppermost circle among the 3 dotted circles within the upper link in FIG. 17).

Here, the shaft 3 is rotated in the clockwise direction by the shaft driving pin 3-1*a* connected to the lower link 4*a* rotating in the clockwise direction, and the movable contactor 2 supported by the shaft 3 is also rotated in the clockwise direction, thereby performing the trip operation in which the movable contactor 2 is separated from the fixed contactors 1*a*, 1*b*.

Meanwhile, description of the contact on operation of the molded case circuit breaker according to the present invention will be given in detail with reference to FIG. 18.

Figure 18:
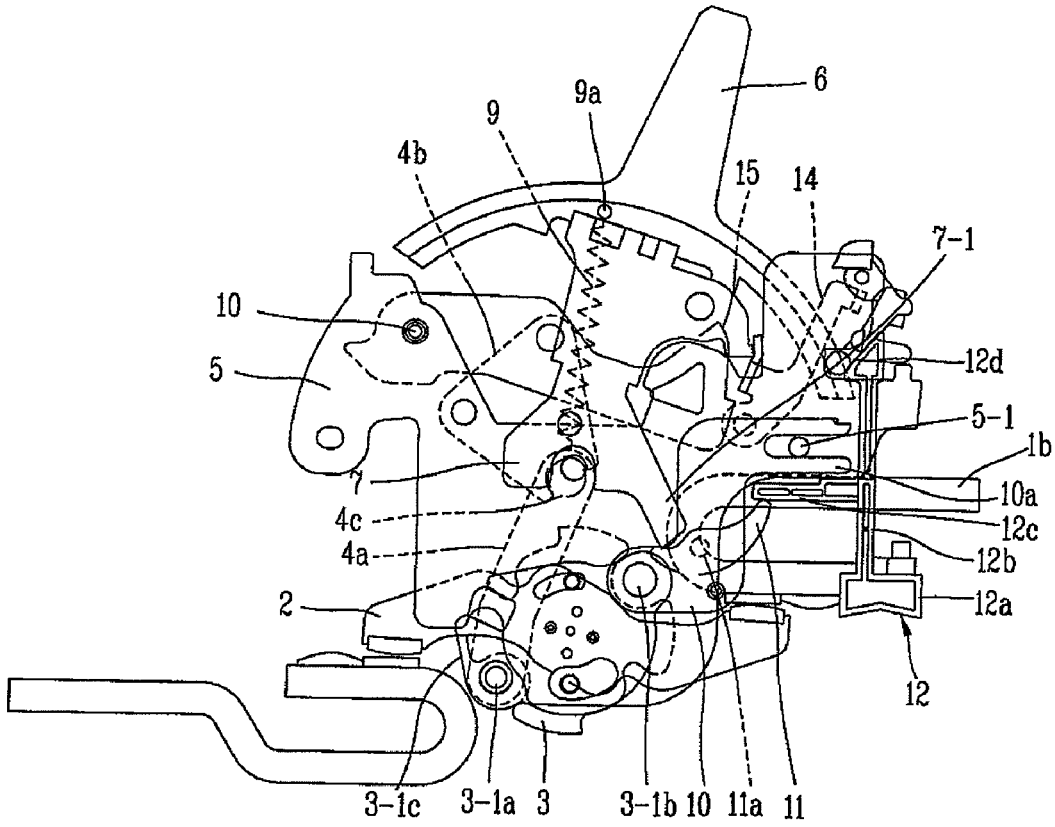
FIG. 18 is a view illustrating an operation state of the main parts of the molded case circuit breaker having a contact on mechanism when the handle is manipulated to move its position to the OFF position before the contact on operation is performed according to the third embodiment of the present invention.

FIG. 18 is a view illustrating an operation state of the main parts of a molded case circuit breaker having a contact on mechanism according to the present invention when the handle is manipulated to move its position to the OFF (reset) position in a contact melt-adhered state before the contact on operation is performed.

Figure 17:
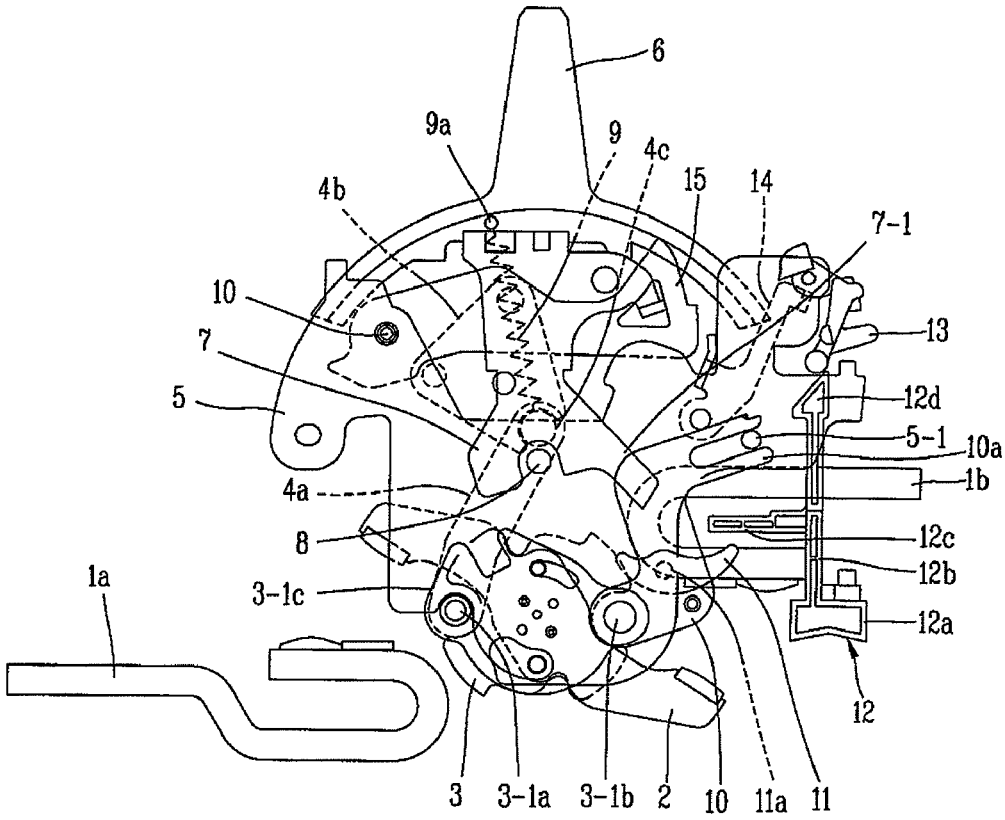
FIG. 17 is a view illustrating an operation state of the main parts of the molded case circuit breaker having a contact on mechanism in a tripped state according to the third embodiment of the present invention.

When the molded case circuit breaker performs a trip operation due to the fault current (e.g., overcurrent, etc.), even though the handle 6 is at the trip position as shown in FIG. 17, contacts of the movable contactor 2 and the fixed contactors 1*a*, 1*b* are melt-adhered to each other or are not separated due to any other reasons, similar to the on position as shown in FIG. 15, thus to be in conducted state. Then, the user may misunderstand that the molded case circuit breaker is in the tripped state and attempt to switch on the circuit breaker.

Here, in order to switch on the molded case circuit breaker in the tripped state, the handle 6 should be manipulated to move its position to the off position first, and then to the on position.

Accordingly, the user manipulates the handle 6 to move its position to the off position. The lever 7 connected to the handle 6 is pivoted centering around the pivot shaft 8 in the clockwise direction (i.e., to the right in FIG. 18) so as to be positioned in the off position, thereby pivoting the lever extending portion 7-1 fixed to the lever 7 in the clockwise direction in FIG. 18.

Here, as the contacts of the movable contactor 2 and the fixed contactors 1*a*, 1*b* are melt-adhered to each other, thus to be in the on position as shown in FIG. 15, the shaft driving pin 3-1*b* (at the right in the drawing) is ascended as well as the contact on plate 10 and the contact on lever 11 are ascended. Thusly, the driving force receiving portion of the contact on lever 11 (the left end in the drawing) is pressed by being contacted by the lever extending portion 7-1 rotating in the clockwise direction, thus to rotate the contact on lever 11 in the counter-clockwise direction.

Accordingly, due to the contact on lever 11 rotating in the counter-clockwise direction, the shooter 12 for upwardly pressing the driving force receiving portion 12*c* is upwardly moved. Then, the nail 13 is pressed by the nail restricting portion 12*d* of the shooter 12, thereby rotating in the clockwise direction. The latch holder 14 is rotated in the counter-clockwise direction. Accordingly, the latch 15 restricted by the latch holder 14 is released and thusly receives a driving force by the elastic potential energy of the trip spring via the upper link 4*b*, thereby rotating in the counter-clockwise direction, thus to perform the trip operation. Here, most of user releases the handle 6 by a relatively loud trip noise from the switching mechanism, which occurs during the trip operation.

In the state that the contacts of the movable contactor 2 and the fixed contactors 1*a*, 1*b* are melt-adhered to each other, the toggle pin 4*c* maintains the position as shown in FIG. 15 not so as to go beyond the pivot shaft 8 in the horizontal direction (i.e., the toggle pin 4*c* is positioned at the left side of the pivot shaft 8 as shown in FIGS. 15 and 18).

Accordingly, the upper portion of the trip spring 9 having the lower end thereof supported by the toggle pin 4*c* is bent to the right by the manipulation of the handle 6 to the off position (i.e., to the right in FIG. 5). If the handle 6 is released from the off position, the upper portion of the trip spring 9 bent to the right is applied by the elastic recovering force for recovering the straight shape with the left lower portion thereof, thereby automatically moving the handle 6 towards the on position, thus to perform the contact on operation.

The position (state) of the molded case circuit breaker according to the present invention after the contact on operation is performed is the same as that of the molded case circuit breaker in the on position as shown in FIG. 15, and detailed explanations therefor are omitted.

According to the present invention, in the condition that the molded case circuit breaker having the contact on mechanism should be tripped, when the contacts are not separated from each other due to the contact melt-adherence, etc., even though the user attempts to move the handle to the off (reset) position, the reset operation is unable to be performed. If the handle 6 is released, the on position is indicated, thus to notify to the user that the molded case circuit breaker is conducted. Accordingly, the user may take actions required for safety.

For instance, the user may block any further overcurrent conduction by manipulating a pre-stage circuit breaker means such as a main circuit breaker in a pre-stage, and take actions of separating the molded case circuit breaker, which caused the disorder, from the wiring, replacing, repairing, and the like.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds, are therefore intended to be embraced by the appended claims.

What is claimed is:

1. In a molded case circuit breaker, which includes fixed contactors, a movable contactor which is movable to a position for contacting the fixed contactors and to a position for being separated from the fixed contactors, a switching mechanism for driving the movable contactor to contact or be separated from the fixed contactors so as to open/close a circuit, a restricting unit for restricting the switching mechanism, and a handle for manually opening/closing the switching mechanism, the molded case circuit breaker, comprising:

a contact on mechanism which trips the switching mechanism by releasing the restricting unit and automatically rotates the handle towards an on position even without manual power so as to indicate a conducted state when the handle is manipulated to move its position to an off position or reset position in a state that contacts of the movable contactor and the fixed contactors are melt-adhered to each other.

2. The molded case circuit breaker of claim 1, wherein the contact on mechanism comprises:

a contact on plate having one end thereof connected to the switching mechanism, and which is vertically movable by being guided according to driving of the switching mechanism;

a trip bar pivotably connected to an upper end of the contact on plate, and that drives the restricting unit to a releasing position;

a lever connected to the handle and that provides a pivot point of the handle;

a lever pin fixed to the lever that moves the restricting unit to the releasing position by pressing the trip bar when the handle is manipulated to move to the off position (or reset position) in a state that the contacts of the movable contactor and the fixed contactors are melt-adhered to each other in the on position, thereby operating the switching mechanism to the trip position; and a trip spring having an upper end thereof connected to the handle, included in the switching mechanism, and that provides an elastic driving force for operating the switching mechanism to the trip position when the restricting unit operated to the releasing position, wherein a horizontal position of a support point for supporting a lower end of the trip spring is positioned not to go beyond a horizontal position of the pivot shaft of the lever, such that, in a state that the contacts of the movable contactor and the fixed contactors are melt-adhered to each other, even though the handle is manipulated to move to the reset position or off position, an elastic force for automatically rotating the handle toward the on position without having manual force so as to indicate the conducted state can be provided.

3. The molded case circuit breaker of claim 2, wherein the lever pin can be configured as a separate pin, or a protruding portion formed by embossing a corresponding position of the lever.

4. In a molded case circuit breaker, which includes a handle, which can indicate an ON position in which a molded case circuit breaker closes a circuit or an OFF position in which the molded case circuit breaker opens the circuit, and providing a manual operation portion for manually operating the molded case circuit breaker; a lever having one end connected to the handle, rotatable together with the handle by engagement with the handle, and providing a pivot point to the handle; a pivot shaft connected to the other end of the lever so as to provide a pivot point to the lever; a side plate for fixedly supporting the pivot shaft; fixed contactors connected to a power source side or a electrical load side, a movable contactor which is pivotable to a position for contacting the fixed contactors and to a position for being separated from the fixed contactors; a shaft for supporting the movable contactor and providing the rotation driving force to the movable contactor; a pair of shaft driving pins for driving the shaft to rotate by engagement with the shaft so as to simultaneously drive the movable contactors for multi-poles; a lower link having a lower end thereof connected to one of the shaft driving pins so as to provide a rotation driving force to the shaft driving pins; an upper link for being connected by engagement with the lower link; a toggle pin for connecting an upper end of the lower link and a lower end of the upper link; a trip spring having both ends each supported by the toggle pin and the handle, charged with an elastic force at the ON position and discharging the elastic force during the trip operation so as to provide the rotation driving force to the shaft; a latch for restricting the trip spring so as to maintain the charged state; a latch holder for being pivotable to a position for restricting the latch and to a position for releasing the latch; and a nail disposed within a pivot track of the latch holder so as to press and pivot the latch holder, the molded case circuit breaker, comprising:

a contact on plate having a lower end thereof connected to one of the shaft driving pins, and which is vertically movable by being guided according to the rotation of the shaft driving pin;

a trip bar pivotably connected to an upper end of the contact on plate, and that is capable of releasing the nail to rotate; and a lever pin fixed to the lever, and that rotates the nail by pressing the trip bar when the handle is manipulated to move to the off position or reset position in a state that contacts of the movable contactor and the fixed contactors are melt-adhered to each other in the on position, thereby tripping the molded case circuit breaker, wherein a horizontal position of the toggle pin supporting a lower end of the trip spring is positioned not to go beyond the horizontal position of the pivot shaft such that, in a state that the contacts of the movable contactor and the fixed contactors are melt-adhered even though the handle is manipulated to move to the reset position or off position, an elastic force for automatically pivoting the handle toward the on position so as to indicate the conducted state even without having manual force can be provided.

5. The molded case circuit breaker of claim 4, wherein in order to vertically guide the contact on plate according to the pivot movement of the shaft driving pin, the side plate comprises a guiding elongate hole for vertically guiding the shaft driving pin and a stopping pin protruding to limit an upward movement of the contact on plate, and the contact on plate comprises an elongate recess portion for surrounding the stopping pin and restricting the upward movement of the contact on plate by the stopping pin.

6. The molded case circuit breaker of claim 4, wherein a boss portion serving as the pivot shaft is formed at an upper end of the contact on plate, and a shaft receiving concaved groove is formed at the trip bar in correspondence to the boss portion such that the trip bar can perform a pivot movement centering around the upper end of the contact on plate.

7. The molded case circuit breaker of claim 4, wherein the contact on plate comprises:

a connection portion formed at a lower end of the contact on plate in a lengthwise direction that connects with one of the shaft driving pins;

an elongate recess portion formed to extend from a central portion of the contact on plate in the lengthwise direction;

a boss portion formed at an upper end of the contact on plate in the lengthwise direction and serving as a pivot shaft of the trip bar so as to pivotably support the trip bar; and a flange portion that extends radially from the boss portion.

8. The molded case circuit breaker of claim 7, wherein the trip bar comprises:

a shaft receiving concaved groove portion disposed at a central portion of the trip bar in the lengthwise direction for receiving the boss portion of the contact on plate;

a flange receiving portion for receiving the flange of the contact on plate;

a nail restricting portion formed to upwardly extend from the central portion of the trip bar in the lengthwise direction, and which is pivotable to a position for restricting the nail or to a position for releasing the nail;

a driving force receiving portion for laterally extending from the central portion of the trip bar in the lengthwise direction so as to receive a rotation driving force; and a balancing weight portion for downwardly extending from the central portion of the trip bar in the lengthwise direction so as to serve as a balance weight.

9. The molded case circuit breaker of claim 4, wherein the lever pin can be configured as a separated pin, or a protruding portion formed by embossing a corresponding position of the lever.

10. In a molded case circuit breaker, which includes fixed contactors, a movable contactor which is movable to a position for contacting the fixed contactors or to a position for being separated from the fixed contactors, a switching mechanism for driving the movable contactor to contact with or be separated from the fixed contactors so as to close/open a circuit, a restricting unit for restricting the switching mechanism, and a handle for manually operating the switching mechanism to opening position or closing position, the molded case circuit breaker, comprising:

a contact on mechanism which trips the switching mechanism by releasing the restricting unit and automatically pivots the handle towards an on position even without manual power when the handle is manipulated to move its position to an off position or reset position in a state that contacts of the movable contactor and the fixed contactors are melt-adhered to each other, the contact on mechanism, comprising:

a contact on plate having one end thereof connected to the switching mechanism, and which is vertically movable and pivotable by being guided according to driving of the switching mechanism;

a contact on lever pivotably connected to an upper end of the contact on plate, and that drives the restricting unit to a restricting position or to a releasing position;

a lever that provides a pivot point of the handle;

a lever extending portion extending from the lever and connected to the contact on plate, that rotates the contact on lever by pressing and rotating the contact on plate when manipulating the handle to move to an OFF position for opening the circuit or an reset position in a state that the contacts of the movable contactor and the fixed contactors are melt-adhered to each other in an ON position for closing the circuit, thereby operating the restricting unit to the releasing position; and a trip spring having an upper end thereof connected to the handle, included in the switching mechanism, and providing an elastic driving force for enabling the switching mechanism to operate to the trip position when the restricting unit is moved to the releasing position, wherein a horizontal position of a support point for supporting a lower end of the trip spring is positioned not to go beyond a horizontal position of the pivot shaft of the lever, such that, in a state that the contacts of the movable contactor and the fixed contactors are melt-adhered to each other, even though the handle is manipulated to move to the reset position or off position, provides an elastic force for automatically rotating the handle toward the on position without having manual force so as to indicate the conducted state can be provided.

11. In a molded case circuit breaker, which includes a handle, which can indicate an ON position in which a molded case circuit breaker closes a circuit or an OFF position in which the molded case circuit breaker opens the circuit, and that provides a manual operation portion for manually operating the molded case circuit breaker; a lever having one end connected to the handle, movable together with the handle according to movement of the handle and that provides a pivot point to the handle; a pivot shaft connected to the other end of the lever so as to provide a pivot point to the lever; a side plate for fixedly supporting the pivot shaft; fixed contactors connected to a power source side or an electrical load side; a movable contactor which is pivotable to a position for contacting the fixed contactors and to a position for being separated from the fixed contactors; a shaft that supports the movable contactor and provides the rotation driving force to the movable contactor; a pair of shaft driving pins that rotates together with the shaft by engagement with the shaft so as to simultaneously drive the movable contactors for multi-poles; a lower link having a lower end thereof connected to one of the shaft driving pins so as to provide a rotation driving force to the shaft driving pins; an upper link for being interlocked by engagement with the lower link; a toggle pin for connecting an upper end of the lower link and a lower end of the upper link; a trip spring having both ends each supported by the toggle pin and the handle, charged with an elastic force at the ON position and discharging the elastic force during the trip operation so as to provide the rotation driving force to the shaft; a latch for restricting the trip spring so as to maintain the charged state; a latch holder for being pivotable to a position for restricting the latch or to a position for releasing the latch; and a nail disposed within a pivot track of the latch holder so as to press and rotate the latch holder, the molded case circuit breaker, comprising:

a contact on plate having a lower end thereof connected to one of the pair of the shaft driving pins, and which is vertically movable by being guided according to the pivot movement of the shaft driving pin;

a contact on lever pivotably connected to an upper end of the contact on plate, and that presses and rotates the nail; and a lever extending portion extending from the lever and connected to the contact on plate, for pressing and rotating the contact on plate so as to enable the contact on lever to press and rotate the nail when manipulating the handle to move to the OFF position or reset position in a state that the contacts of the movable contactor and the fixed contactors are melt-adhered to each other in the ON position;

wherein a horizontal position of the toggle pin supporting a lower end of the trip spring is positioned not to go beyond the horizontal position of the pivot shaft such that, in a state that the contacts of the movable contactor and the fixed contactors are melt-adhered even though the handle is manipulated to move to the reset position or off position, an elastic force for automatically pivoting the handle toward the on position so as to indicate the conducted state even without having manual force can be provided.

12. The molded case circuit breaker of claim 11, wherein the contact on lever comprises:

a nail rotating portion disposed at one end of the contact on lever for pressing the nail; and a driving force receiving portion disposed opposite to the nail rotating portion and protruding in an axial direction so as to receive the rotation driving force from the contact on plate, wherein the contact on plate comprises a first guiding elongate hole portion vertically formed to receive a rotation center shaft of the contact on lever, and a second guiding elongate hole portion for receiving a protruding portion of the contact on lever.

13. In a molded case circuit breaker, which includes fixed contactors, a movable contactor which is movable to a position for contacting the fixed contactors or to a position for being separated from the fixed contactors, a switching mechanism for driving the movable contactor to contact or be separated from the fixed contactors so as to open/close a circuit, a restricting unit for restricting the switching mechanism, and a handle for manually opening/closing the switching mechanism, a lever having one end connected to the handle, movable together with the handle according to movement of the handle and that provides a pivot point to the handle, the molded case circuit breaker, comprising:

a contact on mechanism which trips the switching mechanism by releasing the restricting unit and automatically rotates the handle towards an on position even without manual power so as to indicate a conducted state when the handle is manipulated to move its position to an off position or reset position in a state that contacts of the movable contactor and the fixed contactors are melt-adhered to each other, wherein the contact on mechanism comprises a shooter for pressing the restricting unit thereby moving it to the releasing position when vertically moved;

a contact on plate connected to the switching mechanism, and which is movable in up/down directions by being guided according to an operation of the switching mechanism;

a contact on lever rotatably supported by the contact on plate, for pressing the shooter thereby providing a driving force for the shooter to vertically move when rotated;

a lever extending portion extending from the lever, and upwardly moving the shooter so as to drive the restricting unit to the releasing position by pressing and rotating the contact on lever when the handle is manipulated to move to the off position or reset position in a state that the contacts of the movable contactor and the fixed contactors are melt-adhered to each other in the on position; and a trip spring having an upper end thereof connected to the handle, included in the switching mechanism, and that provides an elastic driving force for moving the switching mechanism to the trip position when the restricting unit is moved to the releasing position, wherein a horizontal position of a support point for supporting a lower end of the trip spring is positioned not to go beyond a horizontal position of the pivot shaft of the lever, such that, in a state that the contacts of the movable contactor and the fixed contactors are melt-adhered to each other, even though the handle is manipulated to move to the reset position or off position, an elastic force for automatically rotating the handle towards the on position without having manual force so as to indicate the conducted state can be provided.

14. In a molded case circuit breaker, which includes a handle, which can indicate an ON position in which the molded case circuit breaker closes a circuit or an OFF position in which the molded case circuit breaker opens the connected circuit, and that provides a manual operation portion for manually operating the molded case circuit breaker; a lever having one end connected to the handle, pivotable together with the handle by engagement with the handle, and providing a pivot point to the handle; a pivot shaft connected to the other end of the lever so as to provide a pivot point to the lever; a side plate for fixedly supporting the pivot shaft; fixed contactors connected to a power source side or an electrical load side; a movable contactor which is pivotable to a position for contacting the fixed contactors or to a position for being separated from the fixed contactors; a shaft for supporting the movable contactor rotatably and that provides the rotation driving force to the movable contactor; a pair of shaft driving pins that connects with the shaft and pivots together with the shaft so as to simultaneously drive the movable contactors for multi-poles; a lower link having a lower end thereof connected to one of the shaft driving pins so as to provide a rotation driving force to the shaft driving pins; an upper link for being interlocked by connecting with the lower link; a toggle pin for connecting an upper end of the lower link and a lower end of the upper link; a trip spring having both ends each supported by the toggle pin and the handle, charged with an elastic force at the ON position and discharging the elastic force during the trip operation so as to provide the rotation driving force to the shaft through the other one of the shaft driving pins; a latch for restricting the trip spring so as to maintain the charged state; a latch holder for being pivotable to a position for restricting the latch and to a position for releasing the latch; and a nail disposed within a pivot track of the latch holder so as to press and rotate the latch holder, the molded case circuit breaker, comprising:

a shooter for vertically moving and that presses and rotates the nail;

a contact on plate connected to one of the pair of the shaft driving pins, and guided to be movable in up/down directions according to a rotation of the shaft driving pin;

a contact on lever rotatably supported by the contact on plate, and for providing a driving force to vertically move the shooter by pressing the shooter when rotated; and a lever extending portion extending from the lever, and upwardly moving the shooter so as to press the nail by pressing and rotating the contact on lever when the handle is manipulated to move to the off position or reset position in a state that the contacts of the movable contactor and the fixed contactors are melt-adhered to each other in the on position;

wherein a horizontal position of the toggle pin supporting a lower end of the trip spring is positioned not to go beyond the horizontal position of the pivot shaft such that, in a state that the contacts of the movable contactor and the fixed contactors are melt-adhered even though the handle is manipulated to move to the reset position or off position, an elastic force for automatically pivoting the handle toward the on position so as to indicate the conducted state even without having manual force can be provided.

15. The molded case circuit breaker of claim 14, wherein in order to vertically guide the contact on plate, the contact on plate is formed to have an "S" shape, a lower portion of the contact on plate is connected to one of the pair of shaft driving pins and a guiding recess portion is provided at an upper portion of the contact on plate in a horizontal direction, and a support pin inserted into the guiding recess portion of the contact on plate is fixed at the side plate so as to support the upper portion of the contact on plate.

16. The molded case circuit breaker of claim 14, wherein the shooter comprises:

a base portion;

a body portion upwardly extending from the base portion;

a driving force receiving portion horizontally extending from a central portion of the body portion in the lengthwise direction so as to be within the rotating track of the one end of the contact on lever; and a nail driving portion disposed at an uppermost end of the body portion, and having a sharp fore-end and an inclined surface contacting the nail so as to rotate the nail.

* * * * *